United States Patent [19]

Momoki et al.

[11] Patent Number: 4,853,321

[45] Date of Patent: Aug. 1, 1989

[54] METHOD OF FORMING A COLOR IMAGE AND SILVER HALIDE COLOR PHOTOGRAPHIC MATERIAL USING DEVELOPER WITH SUBSTANTIALLY NO BENZYL ALCOHOL AND LOW BROMIDE CONCENTRATION

[75] Inventors: Yasuhito Momoki; Masahiro Asami; Nobuo Sakai; Shigeaki Otani, all of Kanagawa, Japan

[73] Assignee: Fuji Photo Film, Co., Ltd., Kanagawa, Japan

[21] Appl. No.: 51,437

[22] Filed: May 19, 1987

[30] Foreign Application Priority Data

May 19, 1986 [JP] Japan ..... 61-114276

[51] Int. Cl.[4] ..... G03C 7/30; G03C 5/24; G03C 1/34

[52] U.S. Cl. ..... 430/380; 430/372; 430/377; 430/382; 430/434; 430/440; 430/445; 430/446; 430/464; 430/467; 430/468; 430/489; 430/544; 430/551

[58] Field of Search ..... 430/372, 377, 464, 468, 430/380, 397, 467, 434, 440, 435, 441, 442, 445, 446, 382, 489, 544, 551

[56] References Cited

U.S. PATENT DOCUMENTS

| | | | |
|---|---|---|---|
| 3,996,054 | 12/1976 | Santemma et al. | 430/490 |
| 4,035,188 | 7/1977 | Tabata et al. | 430/467 |
| 4,299,914 | 11/1981 | Fujumastu et al. | 430/552 |
| 4,304,844 | 12/1981 | Fujumatsu et al. | 430/552 |
| 4,328,302 | 5/1982 | Nishimura et al. | 430/445 |
| 4,418,140 | 11/1983 | Mifune et al. | 430/445 |
| 4,443,536 | 4/1984 | Lestina | 430/552 |
| 4,524,132 | 6/1985 | Aoki et al. | 430/552 |
| 4,526,861 | 7/1985 | Ichijima et al. | 430/385 |
| 4,529,690 | 7/1985 | Ohbayashi et al. | 430/551 |
| 4,564,590 | 1/1986 | Sasaki et al. | 430/552 |
| 4,565,774 | 1/1986 | Kajiwara et al. | 430/382 |
| 4,565,777 | 1/1986 | Ogawa et al. | 430/552 |
| 4,610,954 | 9/1986 | Torigoe et al. | 430/445 |

FOREIGN PATENT DOCUMENTS

| | | | |
|---|---|---|---|
| 211437 | 2/1987 | European Pat. Off. . | |
| 29461 | 8/1974 | Japan . | |
| 52058 | 4/1980 | Japan . | |
| 200037 | 12/1982 | Japan . | |
| 31334 | 2/1983 | Japan . | |
| 42045 | 3/1983 | Japan . | |
| 50536 | 3/1983 | Japan . | |
| 48755 | 3/1984 | Japan . | |
| 90849 | 5/1984 | Japan | 430/544 |
| 174836 | 10/1984 | Japan . | |
| 177553 | 10/1984 | Japan . | |
| 177554 | 10/1984 | Japan . | |
| 177555 | 10/1984 | Japan . | |
| 177556 | 10/1984 | Japan . | |
| 177557 | 10/1984 | Japan . | |
| 178459 | 10/1984 | Japan . | |
| 19140 | 1/1985 | Japan . | |
| 26338 | 2/1985 | Japan . | |
| 26389 | 2/1985 | Japan . | |
| 158444 | 8/1985 | Japan . | |
| 162256 | 8/1985 | Japan . | |
| 158446 | 9/1985 | Japan | 430/464 |
| 172042 | 9/1985 | Japan . | |
| 70552 | 4/1986 | Japan . | |
| 30250 | 2/1987 | Japan . | |

*Primary Examiner*—Paul R. Michl
*Assistant Examiner*—Patricia A. Doody
*Attorney, Agent, or Firm*—Sughrue, Mion, Zinn, Macpeak & Seas

[57] ABSTRACT

A method of forming a color image and a silver halide color photographic material comprising a reflective support having thereon at least one light-sensitive layer containing at least one coupler which forms a dye upon a coupling reaction with an oxidation product of an aromatic primary amine color developing agent and a silver halide emulsion which contains at least 80% by mol of silver chloride and substantially no silver iodide the method comprising processing with a color developing solution which contains not more than 0.002 mol of a bromine ion per liter and substantially no benzyl alcohol for a development time of not more than 2 minutes and 30 seconds in the presence of at least one compound represented by the following formulae (I), (II), or (III), as defined in the specification.

The method of forming a color image and the silver halide color photographic material according to the present invention enable rapid processing to be conducted while controlling the fog formation with high sensitivity.

25 Claims, No Drawings

METHOD OF FORMING A COLOR IMAGE AND SILVER HALIDE COLOR PHOTOGRAPHIC MATERIAL USING DEVELOPER WITH SUBSTANTIALLY NO BENZYL ALCOHOL AND LOW BROMIDE CONCENTRATION

FIELD OF THE INVENTION

The present invention relates to a method of forming a color image and a silver halide color photographic material, and more particularly, to a silver halide color photographic material and a method of forming a color image, which have high sensitivity and enable rapid processing to be conducted with control of fog formation.

BACKGROUND OF THE INVENTION

Many kinds of silver halide color photographic materials and methods of forming color images are commercially available at the present time. Various improvements and inventions thereon have been made depending on the end use. It is generally required that silver halide emulsions employed in these photographic light-sensitive materials have high sensitivity. Therefore, silver iodobromide, silver chloroiodobromide, and silver chlorobromide each being mainly composed of silver bromide, are used as the silver halide in the emulsions at present. Further, various kinds of development accelerators have been investigated in order to increase the color forming property and to shorten the processing time in color development during processing of color photographic light-sensitive materials. Particularly, benzyl alcohol is widely employed at present.

Recently, however, reduction of development processing time, simplification of the processing system and operation, and achievement of low environmental pollution have been highly required in addition to high sensitivity.

This is because reduction of the period to finish, simplification of laboratory work, improvement in productivity and miniaturization, and simple operation of the processing system for small scale laboratories which are designated so-called mini-labos, etc., are desired. With respect to these requirements of rapid processing, simplification of the processing system, and achievement of low environmental pollution, benzyl alcohol which is used in the color developing solution causes severe problems.

Since benzyl alcohol has a low water solubility, it is necessary to use a solvent such as diethylene glycol, etc., in order to assist in dissolution of the benzyl alcohol. These compounds including benzyl alcohol exhibit large values of BOD (biological oxygen demand) and COD (chemical oxygen demand) which indicate a large load for prevention from environmental pollution. Therefore, it is desirable to eliminate these compounds in view of the preservation of good surroundings. Also, it takes much time to dissolve benzyl alcohol in a developing solution even when the above-described solvent is employed and, thus, it is desired to eliminate benzyl alcohol for the purpose of simplification of work for the preparation of the developing solution. However, to simply eliminate benzyl alcohol results in a severe lag of color development which is contrary to the needs of rapid processing in the market. Thus, it has been desired to develop a means which is a substitute for the use of benzyl alcohol.

Silver halides mainly composed of silver bromide which have been mostly employed hitherto are theoretically disadvantageous for the purpose of rapid processing since bromine ions which are released from the silver halides when they are developed have a development inhibiting function. From the standpoint of rapid processing, it is preferred to employ silver halides mainly composed of silver chloride. However, it is known that silver halide emulsions mainly composed of silver chloride have some disadvantages in that they are apt to fog while they have a high development speed; they are poor in preservation stability; and that they have low sensitivity.

Because of their disadvantages described above, it is difficult for silver halides mainly composed of silver chloride to materialize their excellent developability in methods of forming images having relatively high sensitivity.

Accordingly, many attempts have been made in order to overcome these disadvantages. For instance, in order to increase sensitivity, silver chlorobromide emulsions having a high silver chloride content which contain silver chlorobromide grains having a stratiform structure are known. These silver chlorobromide emulsions are described in detail, for example, in Japanese Patent Application (OPI) Nos. 95736/83, 108533/83, 222844/85, and 222845/85 (the term "OPI" as used herein refers to a "published unexamined Japanese patent application"). Further, a method for increasing sensitivity by means of doping metal ions in inner portions of grains is described in Japanese Patent Application (OPI) No. 135832/80. Fog also occurs during sensitization of grains formed. Methods for restraining such a fog are described in Japanese Patent Application (OPI) Nos. 125612/83 and 47940/86.

Although various attempts for increasing sensitivity and restraining the formation of fog with respect to silver halides mainly composed of silver chloride have been made while maintaining their excellent developability, they are still insufficient and, thus, a further improvement has been desired.

SUMMARY OF THE INVENTION

Therefore, an object of the present invention is to provide a silver halide color photographic material which is applicable to rapid processing providing high sensitivity and controlled fog formation, and a method of forming a color image which has a small load for prevention of environmental pollution and simple work for preparation of a processing solution using the silver halide color photographic material.

Another object of the present invention is to provide a method of forming a color image which has a small load for prevention of environmental pollution and simple work for preparation of a processing solution using a silver halide color photographic material which is applicable to rapid processing providing high sensitivity and low fog, whereby simplification of a laboratory work, improvement in productivity and miniaturization, simple operation, and low environmental pollution of the processing system are achieved.

Other objects of the present invention will become apparent from the following description and examples.

These objects of the present invention can be attained by a method of forming a color image which comprises processing a silver halide color photographic material comprising a reflective support having thereon at least one light-sensitive layer containing at least one coupler which forms a dye upon a coupling reaction with an oxidation product of an aromatic primary amine color developing agent and a silver halide emulsion which contains at least 80% by mol of silver chloride and substantially no silver iodide with a color developing solution which contains not more than 0.002 mol of a bromine ion per liter and substantially no benzyl alcohol for a development time of not more than 2 minutes and 30 seconds in the presence of at least one compound represented by the following formulae (I), (II), or (III).

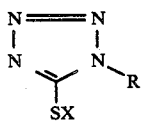

(I)

wherein R represents an alkyl group, an alkenyl group, or an aryl group; and X represents a hydrogen atom, an alkali metal atom, an ammonium group, or a precursor;

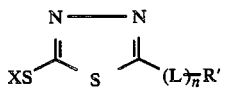

(II)

wherein L represents a divalent connecting group; R′ represents a hydrogen atom, an alkyl group, an alkenyl group, or an aryl group; X has the same meaning as defined in formula (I); and n represents 0 or 1; and

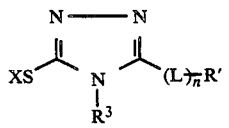

(III)

wherein R′, X, L, and n each has the same meaning as defined in formula (II); $R^3$ has the same meaning as defined for R′; and R′ and $R^3$ may be same or different; or a silver halide color photographic material which comprises a reflective support having thereon at least one light-sensitive layer containing at least one coupler which forms a dye upon a coupling reaction with an oxidation product of an aromatic primary amine color developing agent and a silver halide emulsion which contains at least 80% by mol of silver chloride and substantially no silver iodide, wherein the silver halide color photographic material has at least one layer coated on the support, which contains at least one compound represented by the following formulae (I), (II), or (III):

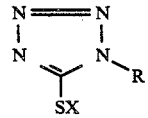

(I)

wherein R represents an alkyl group, an alkenyl group, or an aryl group; and X represents a hydrogen atom, an alkali metal atom, an ammonium group, or a precursor;

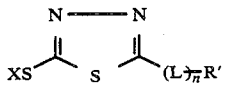

(II)

wherein L represents a divalent connecting group; R′ represents a hydrogen atom, an alkyl group, an alkenyl group, or an aryl group; X has the same meaning as defined in formula (I); and n represents 0 or 1; and

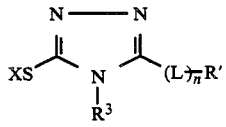

(III)

wherein R′, X, L, and n each has the same meaning as defined in formula (II); $R^3$ has the same meaning as defined for R′; and R′ and $R^3$ may be the same or different, with the amount of the silver halide coated on the support, which is calculated in terms of silver, being not more than 0.78 g/m$^2$.

DETAILED DESCRIPTION OF THE INVENTION

The compounds represented by formulae (I), (II), or (III) will now be described in detail.

The alkali metal atom represented by X includes, for example, a sodium atom and a potassium atom. The ammonium group represented by X includes, for example, a tetramethylammonium group and a trimethylbenzylammonium group. The term "precursor" means a group capable of becoming a hydrogen atom or an alkali metal atom under an alkaline condition and includes, for example, an acetyl group, a cyanoethyl group, and a methanesulfonylethyl group.

The alkyl group and the alkenyl group represented by R, R′, or $R^3$ include an unsubstituted or substituted alkyl group and an unsubstituted or substituted alkenyl group and further may be of an alicyclic form.

Examples of substituents for the substituted alkyl group or the substituted alkenyl group include a halogen atom, a nitro group, a cyano group, a hydroxyl group, an alkoxy group, an aryl group, an acylamino group, an alkoxycarbonylamino group, a ureido group, an amino group, a heterocyclic group, an acyl group, a sulfamoyl group, a sulfonamido group, a thioureido group, a carbamoyl group, an alkylthio group, an arylthio group, a heterocyclic thio group, and a carboxyl group or a sulfonic group or a salt thereof.

The above-described ureido group, thioureido group, sulfamoyl group, carbamoyl group, and amino group each includes an unsubstituted group, an N-alkyl-substituted group, and an N-aryl-substituted group thereof.

The aryl group represented by R, R′, or $R^3$ include, for example, a phenyl group, a substituted phenyl group, etc. Examples of substituents for the substituted aryl group include an alkyl group and the substituents as defined above for the substituted alkyl group.

Suitable examples of the divalent connecting group represented by L include $$-\underset{\underset{R^0}{|}}{N}-,\ -\underset{\underset{R^0}{|}}{N}CO-,\ -\underset{\underset{R^0}{|}}{N}SO_2-,\ -\underset{\underset{R^1}{|}}{N}-\underset{\underset{O}{\|}}{C}-\underset{\underset{R^2}{|}}{N}-,$$

-continued
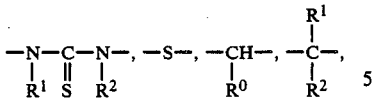
or a combination thereof, wherein $R^0$, $R^1$, and $R^2$ each represents a hydrogen atom, an alkyl group, or an aralkyl group.
Specific examples of the compounds represented by formulae (I), (II), or (III) are set forth below, but the present invention should not be construed as being limited thereto.
(I-1)
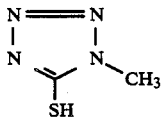
(I-2)
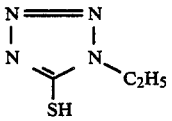
(I-3)
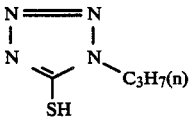
(I-4)
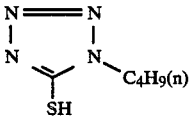
(I-5)
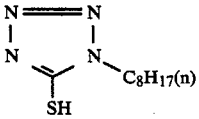
(I-6)
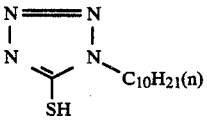
(I-7)
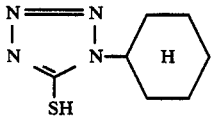
(I-8)
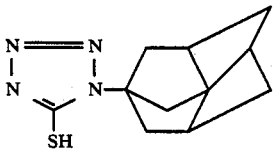
(I-9)
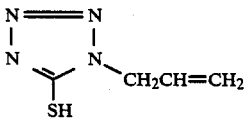
-continued
(I-10)
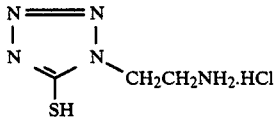
(I-11)
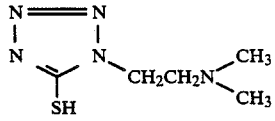
(I-12)
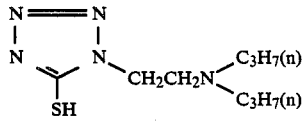
(I-13)
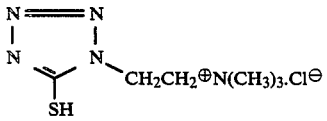
(I-14)
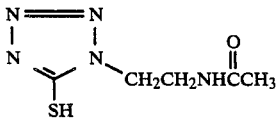
(I-15)
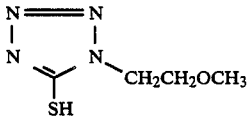
(I-16)
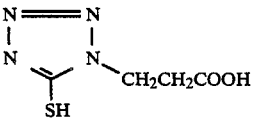
(I-17)
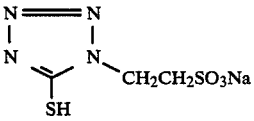
(I-18)
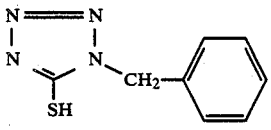
(I-19)
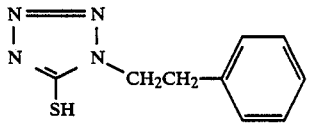
(I-20)
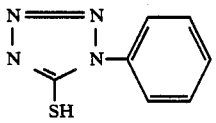
(I-21)
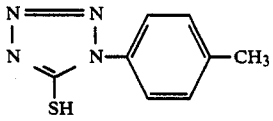

-continued
(I-22)
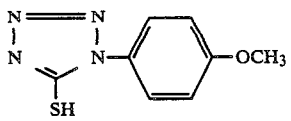
(I-23)
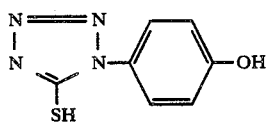
(I-24)
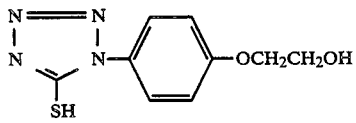
(I-25)
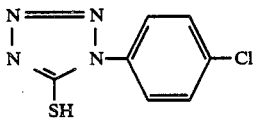
(I-26)
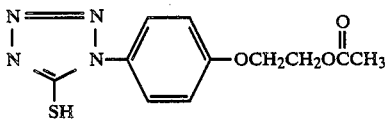
(I-27)
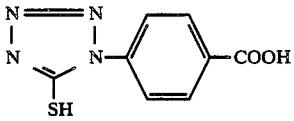
(I-28)
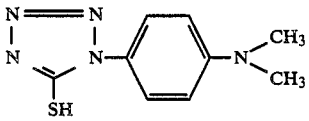
(I-29)
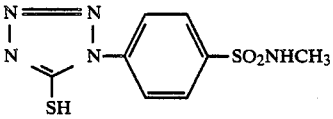
(I-30)
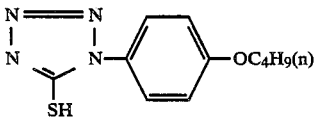
(I-31)
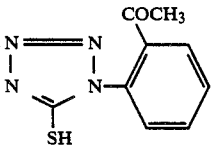
(I-32)
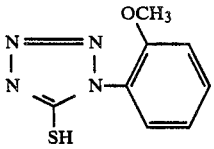
-continued
(I-33)
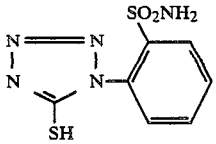
(I-34)
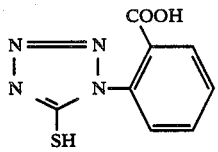
(I-35)
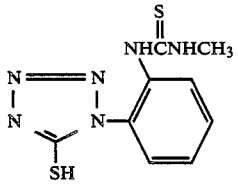
(I-36)
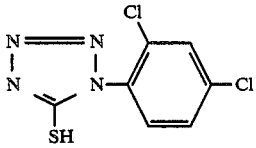
(I-37)
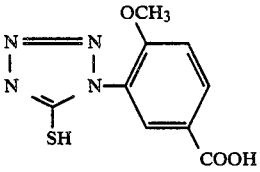
(I-38)
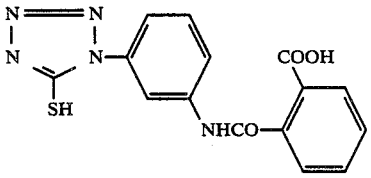
(I-39)
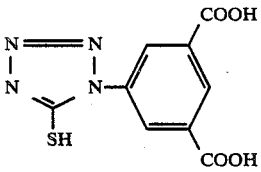
(I-40)
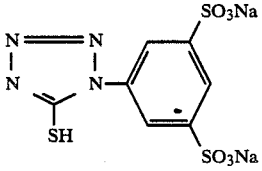
(I-41)
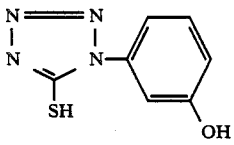

-continued
(I-42)
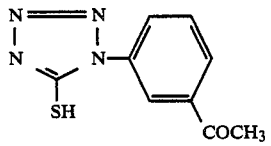
(I-43)
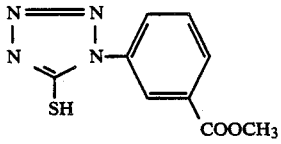
(I-44)
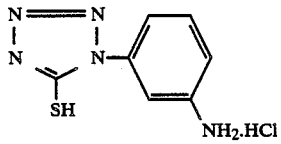
(I-45)
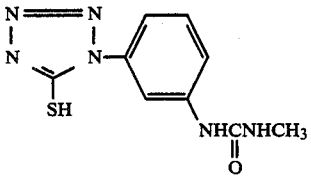
(I-46)
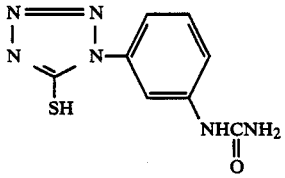
(I-47)
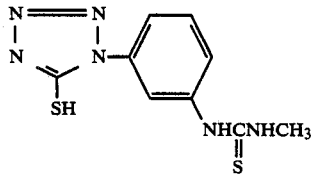
(I-48)
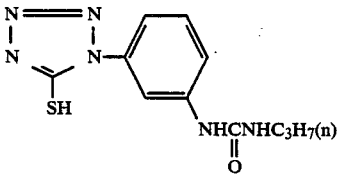
(I-49)
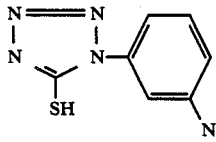
(I-50)
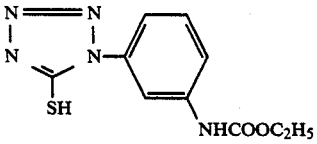
-continued
(I-51)
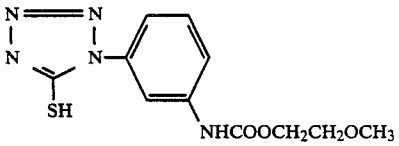
(I-52)
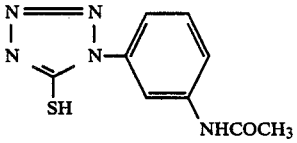
(I-53)
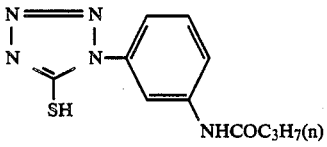
(I-54)
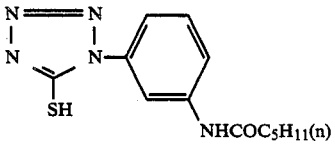
(I-55)
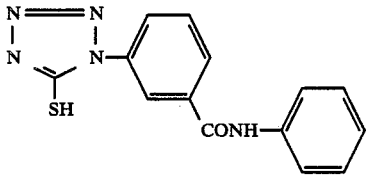
(I-56)
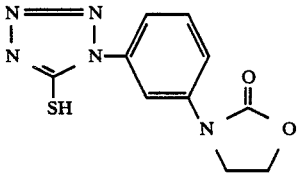
(I-57)
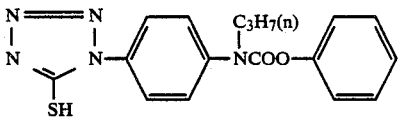
(I-58)
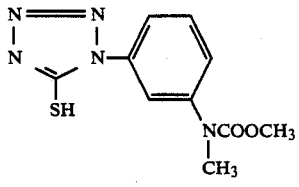
(I-59)
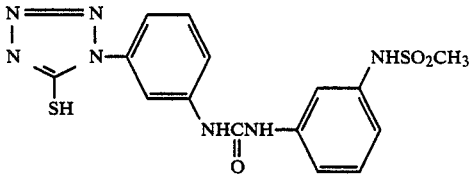

-continued
(I-60)
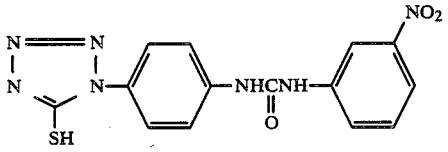
(I-61)
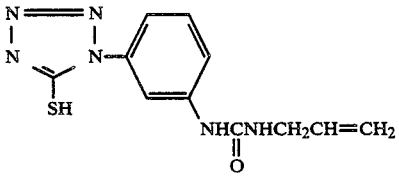
(I-62)
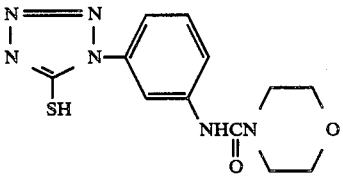
(I-63)
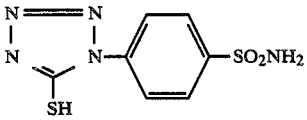
(I-64)
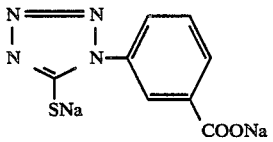
(I-65)
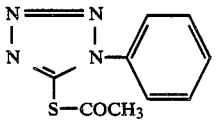
(I-66)
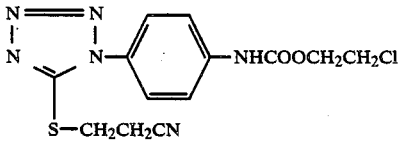
(I-67)
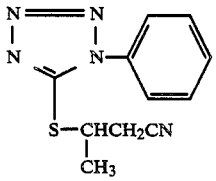
(I-68)
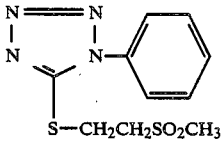
-continued
(I-69)
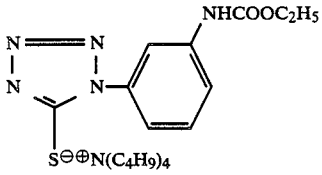
(I-70)
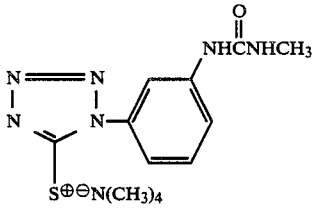
(I-71)
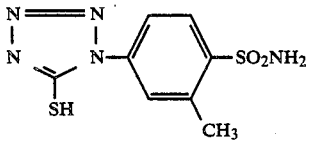
(I-72)
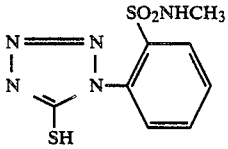
(II-1)
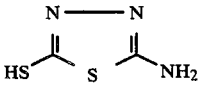
(II-2)
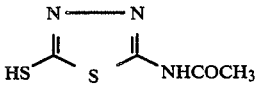
(II-3)
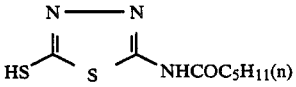
(II-4)
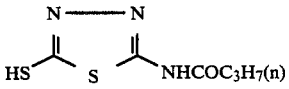
(II-5)
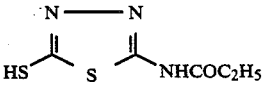
(II-6)
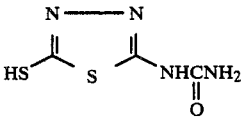
(II-7)
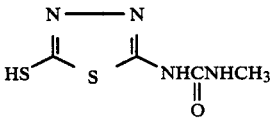
(II-8)
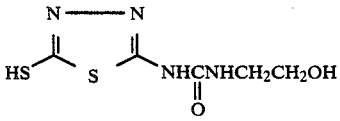

-continued
(II-9)
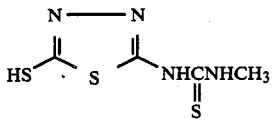
(II-10)
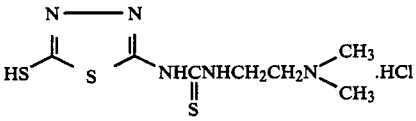
(II-11)
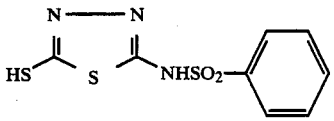
(II-12)
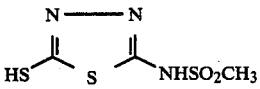
(II-13)
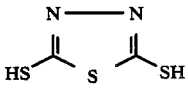
(II-14)
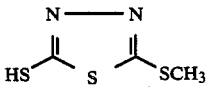
(II-15)
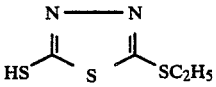
(II-16)
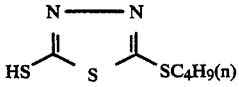
(II-17)
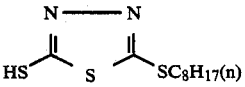
(II-18)
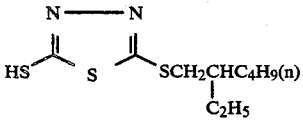
(II-19)
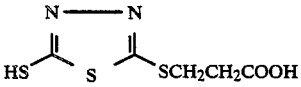
(II-20)
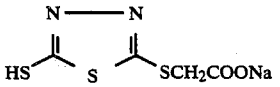
(II-21)
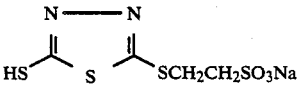
(II-22)
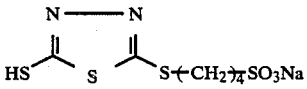
-continued
(II-23)
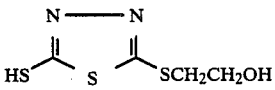
(II-24)
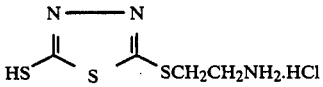
(II-25)
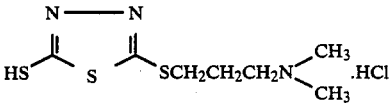
(II-26)
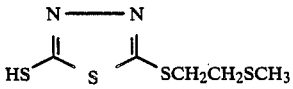
(II-27)
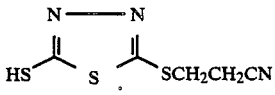
(II-28)
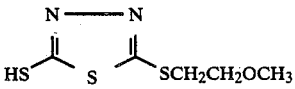
(II-29)
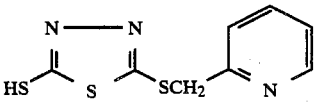
(II-30)
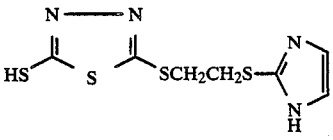
(II-31)
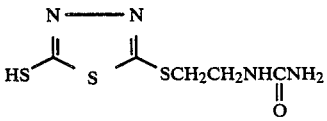
(II-32)
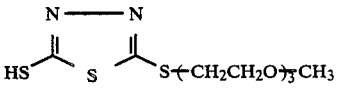
(II-33)
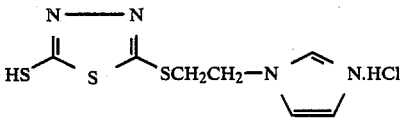
(II-34)
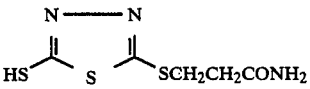
(II-35)
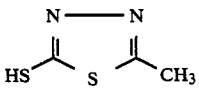
(II-36)
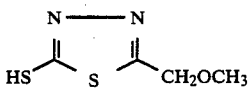

-continued
(II-37)
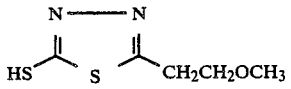
(II-38)
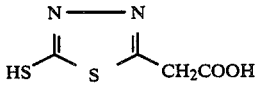
(II-39)
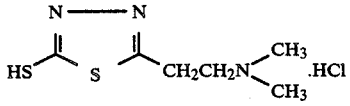
(II-40)
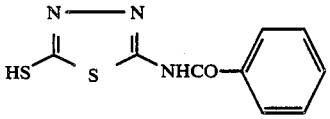
(II-41)
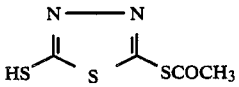
(II-42)
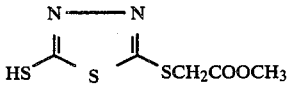
(II-43)
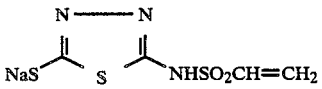
(II-44)
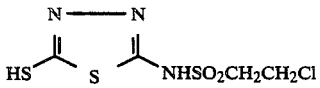
(II-45)
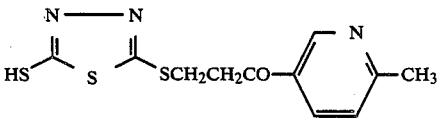
(II-46)
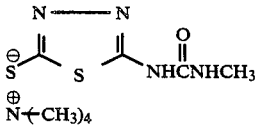
(II-47)
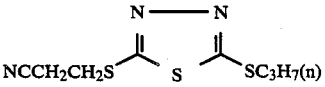
(III-1)
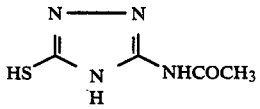
(III-2)
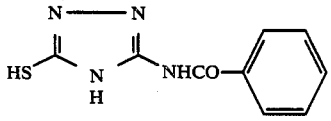
(III-3)
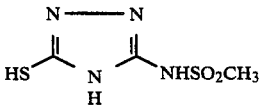
-continued
(III-4)
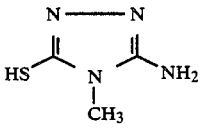
(III-5)
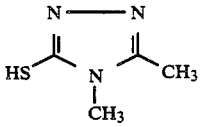
(III-6)
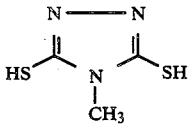
(III-7)
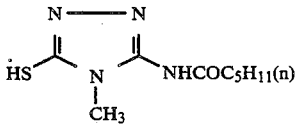
(III-8)
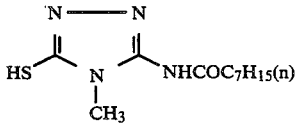
(III-9)
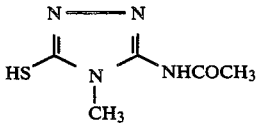
(III-10)
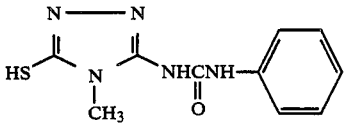
(III-11)
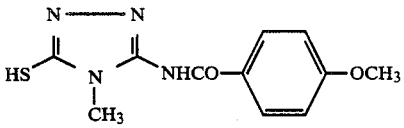
(III-12)
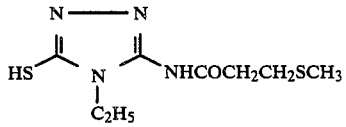
(III-13)
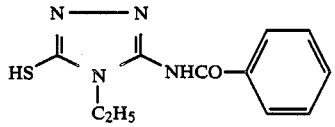
(III-14)
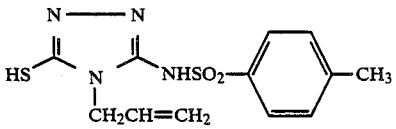

-continued
(III-15)
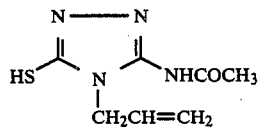
(III-16)
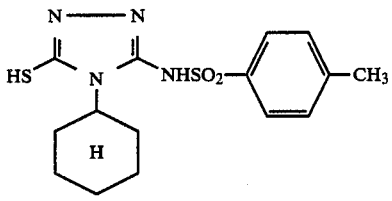
(III-17)
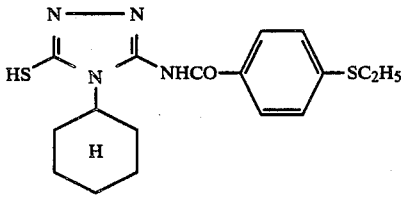
(III-18)
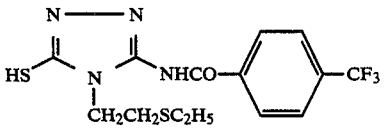
(III-19)
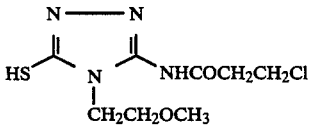
(III-20)
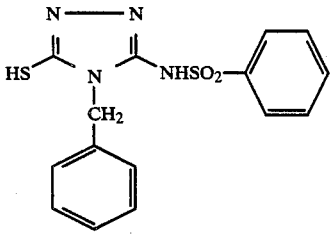
(III-21)
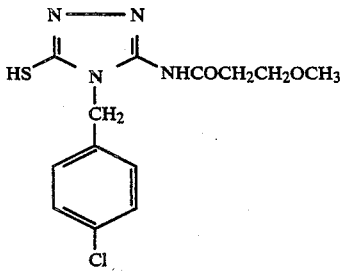
III-22)
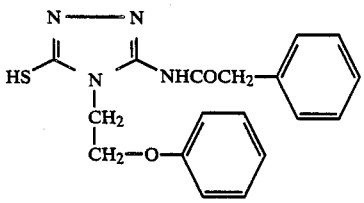
-continued
(III-23)
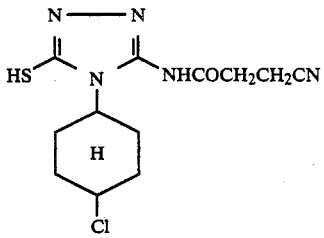
(III-24)
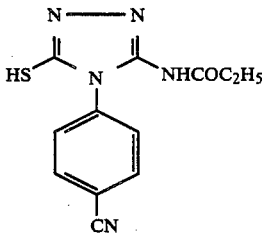
(III-25)
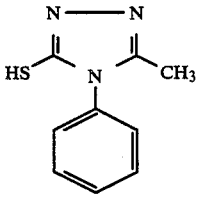
(III-26)
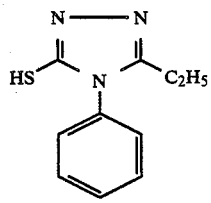
(III-27)
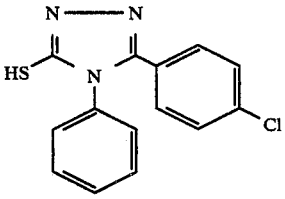
(III-28)
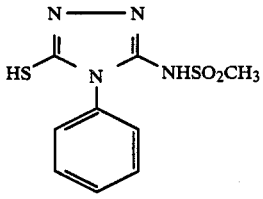
(III-29)
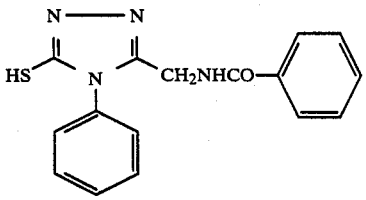

-continued (III-30)

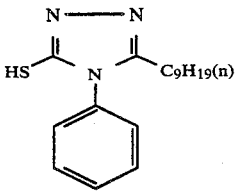

(III-31)

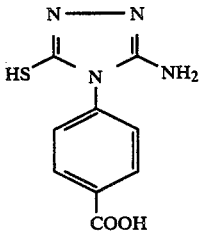

(III-32)

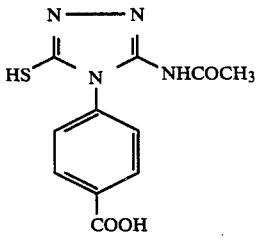

(III-33)

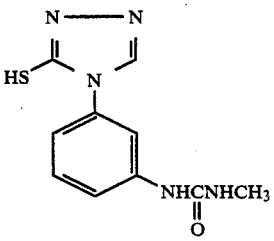

(III-34)

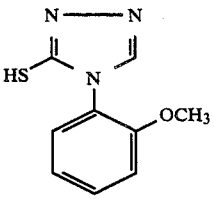

(III-35)

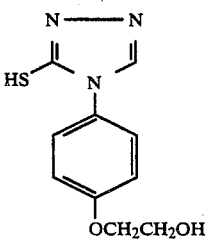

(III-36)

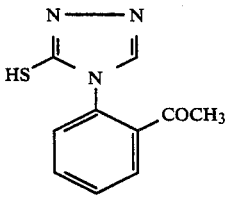

-continued (III-37)

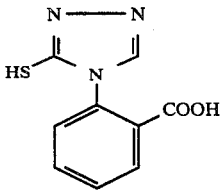

(III-38)

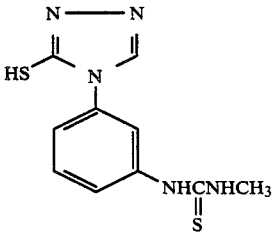

(III-39)

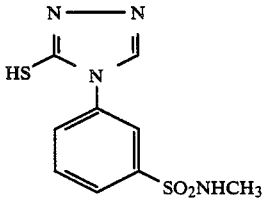

(III-40)

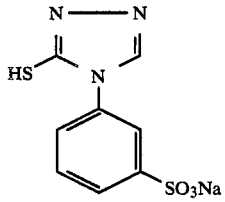

The compound represented by formulae (I), (II), or (III) used in the present invention can be added to any layer of a silver halide color photographic material or to the color developing solution. Suitable layers of the silver halide color photographic material include a light-sensitive hydrophilic colloid layer and a light-insensitive hydrophilic colloid layer.

The amount of the compound represented by formulae (I), (II), or (III) to be incorporated into a silver halide color photographic material is preferably from $10\times10^{-5}$ mol to $5\times10^{-2}$ mol and more preferably from $1\times10^{-4}$ mol to $1\times10^{-2}$ mol per mol of the silver halide. On the other hand, in the case of adding the compound to a color developing solution, the amount added is preferably from $1\times10^{-6}$ mol to $1\times10^{-3}$ mol and more preferably from $5\times10^{-6}$ mol to $5\times10^{-4}$ mol per liter of the solution.

When the amount of the compound added is smaller than the above-described value, the antifogging effect on the silver halide emulsion may be insufficient and cause color turbidity. On the contrary, use of a larger amount of the compound than the above-described value may cause a decrease in sensitivity or a decrease in density due to restraint of development which results in deterioration of color reproducibility.

The term "color developing solution containing substantially no benzyl alcohol" as used in the present invention means a color developing solution containing benzyl alcohol in a concentration of not more than 0.5 ml per liter of the solution. It is preferred that the color developing solution does not contain benzyl alcohol at all.

The amount of bromine ions contained in the color developing solution used in the present invention is not more than 0.002 mol and preferably not more than 0.0007 mol per liter of the solution. Most preferably, the color developing solution does not contain bromine ions at all. Although the amount of bromine ions relates to the content of silver bromide in the silver halide emulsion, when a higher amount thereof than the above-described value is employed, there is a tendency to restrain development, whereby sufficiently high density cannot be obtained.

The silver halide emulsion which can be used in the present invention comprises a silver halide containing at least 80% by mol of silver chloride and substantially no silver iodide. The content of silver chloride in the silver halide emulsion is preferably at least 90% by mol and more preferably at least 95% by mol. A pure silver chloride emulsion can be employed. When the content of silver chloride in the emulsion is lower than the above-described value, the development proceeds slowly, whereby it is difficult to obtain sufficiently high density.

The term "silver halide emulsion containing substantially no silver iodide" as used in the present invention means a silver halide emulsion having a content of silver iodide of not more than 1% by mol and more preferably not more than 0.5% by mol. Most preferably, the silver halide emulsion does not contain silver iodide at all. To add silver iodide is not desired because of retardation in development speed and increase in fog in some cases.

The amount of the silver halide coated on a reflective support which is calculated in terms of silver is preferably not more than 0.78 $g/m^2$. When the amount of the silver halide coated is too great, the development again proceeds slowly, whereby it is difficult to obtain a sufficiently high density.

The average grain size of silver halide grains in the silver halide emulsion used in the present invention (the grain size being defined as grain diameter if the grain has a spherical or approximately spherical shape, or as the edge length in the case of cubic grains, and being averaged based on the projected areas of the grains) is preferably from 0.1 μm to 2 μm and more preferably from 0.2 μm to 1.3 μm. Further, it is preferred to employ a monodispersed silver halide emulsion. The grain size distribution which represents a degree of the monodispersibility is preferably not more than 0.2 and more preferably not more than 0.15 in terms of a ratio ($s/\bar{d}$) of a statistical standard deviation (s) to an average grain size ($\bar{d}$).

Silver halide grains which can be used in the present invention may have different layers in the inner portion and on the surface portion, multiphase structures containing junctions or may be uniform throughout the grains. Further, a mixture of these silver halide grains having different structures may be employed.

Silver halide grains which can be used in the present invention may have a regular crystal structure, for example, a cubic, octahedral, dodecahedral, or tetradecahedral structure; an irregular crystal structure, for example, a spherical structure; or a composite structure thereof. Further, tabular silver halide grains can be used. Particularly, a silver halide emulsion can be employed wherein tabular silver halide grains having a ratio of diameter/thickness of at least 5 and preferably at least 8 account for at least 50% of the total projected area of the silver halide grains present. In addition, mixtures of silver halide grains having different crystal structures may be used. These silver halide emulsions may be those of the surface latent image type in which latent images are formed mainly on the surface thereof and those of the internal latent image type in which latent images are formed mainly in the interior thereof.

Photographic emulsions as used in the present invention can be prepared in any suitable manner, for example, by the methods as described in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964). That is, any of an acid process, a neutral process, and an ammonia process can be employed.

Soluble silver salts and soluble halogen salts can be reacted by techniques such as a single jet process, a double jet process, and a combination thereof. In addition, there can be employed a method (a so-called reversal mixing process) in which silver halide grains are formed in the presence of an excess of silver ions. As one system of the double jet process, a so-called controlled double jet process in which the pAg in a liquid phase where a silver halide is formed is maintained at a predetermined level can be employed. This process gives a silver halide emulsion in which the crystal form is regular and the particle size is nearly uniform.

Further, a silver halide emulsion may be employed which is prepared by a so-called conversion method involving a process in which a silver halide previously formed is converted to a silver halide having a lower solubility before the completion of formation of silver halide grains or in which a silver halide emulsion is subjected to similar halogen conversion after the completion of formation of silver halide grains.

During the step of formation or physical ripening of silver halide grains, cadmium salts, zinc salts, lead salts, thallium salts, iridium salts or complex salts thereof, rhodium salts or complex salts thereof, and iron salts or complex salts thereof may be allowed to coexist.

After the formation of silver halide grains, the silver halide emulsions are usually subjected to physical ripening, removal of soluble salts, and chemical ripening and then employed for coating.

Known silver halide solvents (for example, ammonia, potassium thiocyanate, and thioethers or thione compounds as described in U.S. Pat. No. 3,271,157 and Japanese Patent Application (OPI) Nos. 12360/76, 82408/78, 144319/78, 100717/79, and 155828/79) can be employed during the step of formation, physical ripening, or chemical ripening of the silver halide.

For removal of soluble silver salts from the emulsion after physical ripening, a noodle washing process, a flocculation process, or an ultrafiltration process can be employed.

To the silver halide emulsion which can be used in the present invention, a sulfur sensitization method using active gelatin or compounds containing sulfur capable of reacting with silver (for example, thiosulfates, thioureas, mercapto compounds, and rhodanines), a reduction sensitization method using reducing substances (for example, stannous salts, amines, hydrazine derivatives, formamidinesulfinic acid, and silane compounds), a noble metal sensitization method using metal compounds (for example, complex salts of Group VIII metals in the Periodic Table, such as Pt, Ir, Pd, Rh, or Fe as well as gold complex salts); and so forth can be applied alone or in combination with each other.

Of the above-described chemical sensitizations, a sulfur sensitization alone is preferred.

Further, in order to achieve the desired gradation of the color photographic light-sensitive material, two or more monodispersed silver halide emulsions which have substantially the same spectral sensitivity but have different grain sizes from each other can be mixed in one emulsion layer or can be coated in the form of superimposed layers (regarding monodispersibility, the coefficient of variation described above is preferred). Moreover, two or more polydispersed silver halide emulsions or combinations of a monodispersed emulsion and a polydispersed emulsion may be employed in a mixture or in the form of superimposed layers.

Each of blue-sensitive, green-sensitive, and red-sensitive emulsions used in the present invention can be spectrally sensitized with methine dyes or other dyes so as to have each color sensitivity. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes, and complex merocyanine dyes are particularly useful.

Any conventionally utilized nuclei for cyanine dyes are applicable to these dyes as basic heterocyclic nuclei. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus, and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms on these nuclei can also be substituted.

The merocyanine dyes and the complex merocyanine dyes that can be employed contain 5- or 6-membered heterocyclic nuclei such as a pyrazolin-5-one nucleus, a thiohydantoin nucleus, a 2-thioxazolidin-2,4-dione nucleus, a thiazolidon-2,4-dione nucleus, a rhodanine nucleus, and a thiobarbituric acid nucleus as nuclei having a ketomethylene structure.

These sensitizing dyes can be employed individually, but can also be employed in combination. A combination of sensitizing dyes is often used particularly for the purpose of supersensitization. Typical examples of supersensitizing combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Pat. Nos. 1,344,281 and 1,507,803, Japanese Patent Publication Nos. 4936/68 and 12375/78, and Japanese Patent Application (OPI) Nos. 110618/77 and 109925/77.

The sensitizing dyes may be present in the emulsion together with dyes which themselves do not give rise to spectrally sensitizing effects but exhibit a supersensitizing effect or materials which do not substantially absorb visible light but exhibit a supersensitizing effect.

It is preferable that couplers which are incorporated into photographic light-sensitive materials are diffusion resistant by means of containing a ballast group or polymerizing. It is also preferred that the coupling active sites of couplers be substituted with a group capable of being split off (2-equivalent couplers) rather than with a hydrogen atom (4-equivalent couplers) from the standpoint that the coating amount of silver is reduced. Further, couplers which form dyes having an appropriate diffusibility, non-color-forming couplers, or couplers capable of releasing development inhibitors (DIR couplers) or development accelerators accompanying the coupling reaction can be employed.

As typical yellow couplers used in the present invention, oil protected acylacetamide type couplers are exemplified. Specific examples thereof are described in U.S. Pat. Nos. 2,407,210, 2,875,057, and 3,265,506. In the present invention, 2-equivalent yellow couplers are preferably employed, and typical examples thereof include yellow couplers of the oxygen atom-releasing type as described in U.S. Pat. Nos. 3,408,194, 3,447,928, 3,933,501, and 4,022,620; and yellow couplers of the nitrogen atom-releasing type as described in Japanese Patent Publication No. 10739/83, U.S. Pat. Nos. 4,401,752 and 4,326,024, *Research Disclosure,* RD No. 18053 (April, 1979), British Pat. No. 1,425,020, West German Patent Application (OLS) Nos. 2,219,917, 2,261,361, 2,329,587, and 2,433,812. α-Pivaloylacetanilide type couplers are characterized by good fastness, particularly good light fastness, of the dyes formed, and α-benzoylacetanilide type couplers are characterized by providing high color density.

As magenta couplers used in the present invention, oil protected indazolone type couplers and cyanoacetyl type couplers, preferably 5-pyrazolone type couplers and pyrazoloazole type couplers such as pyrazolotriazoles, are exemplified. Of 5-pyrazolone type couplers, those substituted with an arylamino group or an acylamino group at the 3-position thereof are preferred in view of hue and color density of the dyes formed. Typical examples thereof are described in U.S. Pat. Nos. 2,311,082, 2,343,703, 2,600,788, 2,908,573, 3,062,653, 3,152,896, and 3,936,015. 2-Equivalent 5-pyrazolone type couplers are preferably used. Particularly, nitrogen atom-releasing groups as described in U.S. Pat. No. 4,310,619 and arylthio groups as described in U.S. Pat. No. 4,351,897 are preferred as split-off groups. Further, 5-pyrazolone type couplers having a ballast group as described in European Pat. No. 73,636 are advantageous because they provide high color density.

Examples of pyrazoloazole type couplers include pyrazolobenzimidazoles as described in U.S. Pat. No. 3,369,879, and preferably pyrazolo[5,1-c][1,2,4]triazoles as described in U.S. Pat. No. 3,725,067, pyrazolotetrazoles as described in *Research Disclosure,* RD No. 24220 (June, 1984), and pyrazolopyrazoles as described in *Research Disclosure,* RD No. 24230 (June, 1984). Imidazo[1,2-b]-pyrazoles as described in European Pat. No. 119,741 are preferred, and pyrazolo[1,5-b][1,2,4]triazoles as described in European Pat. No. 119,860 are particularly preferred in view of less yellow subsidiary absorption and light fastness of the dyes formed.

As cyan couplers used in the present invention, oil protected naphthol type and phenol type couplers are exemplified. Typical examples thereof include naphthol type couplers as described in U.S. Pat. No. 2,474,293 and preferably oxygen atom-releasing type 2-equivalent naphthol type couplers as described in U.S. Pat. Nos.

4,052,212, 4,146,396, 4,228,233, and 4,296,200. Specific examples of phenol type couplers are described in U.S. Pat. Nos. 2,369,929, 2,801,171, 2,772,162, and 2,895,826.

Cyan couplers fast to humidity and temperature are preferably used in the present invention. Typical examples thereof include phenol type cyan couplers having an alkyl group larger than a methyl group at the metaposition of the phenol nucleus as described in U.S. Pat. No. 3,772,002; 2,5-diacylamino-substituted phenol type couplers as described in U.S. Pat. Nos. 2,772,162, 3,758,308, 4,126,396, 4,334,011, and 4,327,173, West German Patent Application (OLS) No. 3,329,729, and Japanese Patent Application (OPI) No. 166956/84); and phenol type couplers having a phenylureido group at the 2-position thereof and an acylamino group at the 5-position thereof as described in U.S. Pat. Nos. 3,446,622, 4,333,999, 4,451,559, and 4,427,767.

Further, couplers capable of forming appropriately diffusible dyes can be used together in order to improve graininess. Specific examples of such dye diffusible types of magenta couplers are described in U.S. Pat. No. 4,366,237 and British Pat. No. 2,125,570, and those of yellow, magenta, and cyan couplers are described in European Pat. No. 96,570 and West German Patent Application (OLS) No. 3,234,533.

These dye-forming couplers and special couplers described above may be used in the form of polymers including dimers or larger. Typical examples of dye-forming polymer couplers are described in U.S. Pat. Nos. 3,451,820 and 4,080,211. Specific examples of magenta polymer couplers are described in British Pat. No. 2,102,173 and U.S. Pat. No. 4,367,282.

Two or more kinds of various couplers which can be used in the present invention can be incorporated together into the same layer for the purpose of satisfying the properties required of the color photographic light-sensitive materials, or the same compound can be incorporated into two or more different layers.

Couplers which can be used in the present invention may be introduced into the color photographic light-sensitive material using an oil-in-water droplet type dispersing method. By means of the oil-in-water droplet type dispersing method, couplers are dissolved in either an organic solvent having a high boiling point of 175° C. or more, a so-called auxiliary solvent having a low boiling point, or a mixture thereof and, then, the solution is finely dispersed in an aqueous medium such as water or an aqueous gelatin solution in the presence of a surface active agent. Specific examples of the organic solvent having a high boiling point are described in, for example, U.S. Pat. No. 2,322,027. Preparation of a dispersion may be accompanied by phase inversion. Further, dispersions can be utilized for coating after removing or reducing the auxiliary solvent therein by distillation, noodle washing, or ultrafiltration, if desired.

Specific examples of the organic solvent having a high boiling point include phthalic acid esters (for example, dibutyl phthalate, dicyclohexyl phthalate, di-2-ethylhexyl phthalate, and didecyl phthalate), phosphoric or phosphonic acid esters (for example, triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, and di-2-ethylhexylphenyl phosphonate), benzoic acid esters (for example, 2-ethylhexyl benzoate, dodecyl benzoate, and 2-ethylhexyl-p-hydroxybenzoate), amides (for example, diethyldodecanamide and N-tetradecylpyrrolidone), alcohols or phenols (for example, isostearyl alcohol and 2,4-di-tert-amylphenol), aliphatic carboxylic acid esters (for example, dioctyl azelate, glycerol tributyrate, isostearyl lactate, and trioctyl citrate), aniline derivatives (for example, N,N-dibutyl-2-butoxy-5-tert-octylaniline), and hydrocarbons (for example, paraffins, dodecylbenzene, and diisopropylnaphthalene). As the auxiliary solvent, organic solvents having a boiling point of about 30° C. or more, preferably from about 50° C. to about 160° C., can be used. Typical examples of such auxiliary solvents include ethyl acetate, butyl acetate, ethyl propionate, methyl ethyl ketone, cyclohexanone, 2-ethoxyethyl acetate, and dimethylformamide.

The processes and effects of latex dispersing methods and the specific examples of latices for loading are described in U.S. Pat. No. 4,199,363 and West German Patent Application (OLS) Nos. 2,541,274 and 2,541,230.

The color couplers are generally employed in an amount of from 0.001 mol to 1 mol per mol of the light-sensitive silver halide contained in a layer to be added. It is preferred that amounts of yellow couplers, magenta couplers, and cyan couplers used are in ranges of from 0.01 mol to 0.5 mol, from 0.003 mol to 0.3 mol, and from 0.002 mol to 0.3 mol, respectively, per mol of the light-sensitive silver halide.

The color photographic ligght-sensitive material used in the present invention may contain hydroquinone derivatives, aminophenol derivatives, amines, gallic acid derivatives, catechol derivatives, ascorbic acid derivatives, non-color-forming couplers, and sulfonamidophenol derivatives, as color fog preventing agents or color mixing preventing agents.

In the color photographic light-sensitive material used in the present invention, various known color fading preventing agents can be employed. Typical examples of organic color fading preventing agents include hindered phenols, for example, hydroquinones, 6-hydroxychromans, 5-hydroxycoumarans, spirochromans, p-alkoxyphenols, and bisphenols, gallic acid derivatives, methylenedioxybenzenes, aminophenols, hindered amines, or ether or ester derivatives thereof derived from each of these compounds by silylation or alkylation of the phenolic hydroxyl group thereof. Further, metal complexes represented by (bissalicylaldoxymate) nickel complexes and (bis-N,N-dialkyldithiocarbamate) nickel complexes may be employed.

For the purpose of preventing degradation of yellow dye images due to heat, humidity, and light, compounds each having both a hindered amine partial structure and a hindered phenol partial structure in the molecule as described in U.S. Pat. No. 4,268,593 provide good results. For the purpose of preventing degradation of magenta dye images, particularly degradation due to light, spiroindanes as described in Japanese Patent Application (OPI) No. 159644/81 and chromans substituted with a hydroquinone diether or monoether as described in Japanese Patent Application (OPI) No. 89835/80 provide preferred results.

In order to improve preservability, particularly light fastness of cyan dye images, it is preferred to employ together a benzotriazole type ultraviolet light absorbing agent. Such an ultraviolet light absorbing agent may be emulsified together with a cyan coupler. A coating amount of the ultraviolet light absorbing agent is selected so as to sufficiently improve the light stability of cyan dye images. When the amount of the ultraviolet light absorbing agent employed is too large, yellow coloration may occur in unexposed areas (white background areas) of color photographic materials containing them. Therefore, it is usual that the amount is preferably determined in a range of from $1\times10^{-4}$ mol/m$^2$ to $2\times10^{-3}$ mol/m$^2$ and particularly from $5\times10^{-4}$ mol/m$^2$ to $1.5\times10^{-3}$ mol/m$^2$.

In color paper having a conventional light-sensitive layer structure, the ultraviolet light absorbing agent is incorporated into one of two layers adjacent to a red-sensitive emulsion layer containing a cyan coupler and preferably both thereof. When the ultraviolet light absorbing agent is incorporated into an interlayer positioned between a green-sensitive emulsion layer and a red-sensitive emulsion layer, it may be emulsified together with a color mixing preventing agent. In the case of adding the ultraviolet light absorbing agent to a protective layer, another protective layer may be separately provided thereon as an outermost layer. Into the outermost protective layer, a matting agent having an appropriate particle size can be incorporated.

The color photographic light-sensitive material used in the present invention may contain an ultraviolet light abosrbing agent in a hydrophilic colloid layer thereof.

The color photographic light-sensitive material used in the present invention may contain water-soluble dyes as filter dyes or for irradiation of halation prevention or other various purposes in a hydrophilic colloid layer thereof.

The color photographic light-sensitive material used in the present invention may contain in the photographic emulsion layers or other hydrophilic colloid layers a brightening agent of the stilbene series, triazine series, oxazole series, or coumarin series. Water-soluble brightening agents can be employed. Also, wate-insoluble brightening agents may be used in the form of a dispersion.

The present invention can be applied to a multilayer multicolor photographic light-sensitive material having at least two differently spectrally sensitized silver halide photographic emulsion layers on a support. The multilayer natural color photographic light-sensitive material usually has at least one red-sensitive silver halide emulsion layer, at least one green-sensitive silver halide emulsion layer, and at least one blue-sensitive silver halide emulsion layer on a support. The order of the disposition of these emulsion layers can be suitably selected depending on demands.

Further, each of the above-described emulsion layers may be composed of two or more emulsion layers having different sensitivities. Moreover, between two or more emulsion layers sensitive to the same spectral wavelength range, a light-insensitive layer may be present.

In the color photographic light-sensitive material according to the present invention, it is preferred to provide a subsidiary layer such as a protective layer, an interlayer, a filter layer, an antihalation layer, and a back layer appropriately in addition to the silver halide emulsion layer.

As the binder or the protective colloid for the photographic emulsion layers or interlayers of the color photographic light-sensitive material according to the present invention, gelatin is advantageously used, but other hydrophilic colloids can also be used.

For example, it is possible to use proteins such as gelatin derivatives, graft polymers of gelatin and other polymers, albumin, and casein; saccharide derivatives such as cellulose derivatives (e.g., hydroxyethyl cellulose, carboxymethyl cellulose, and cellulose sulfate), sodium alginate, and starch derivatives; and various synthetic hydrophilic high molecular weight substances such as homopolymers or copolymers (e.g., polyvinyl alcohol, polyvinyl alcohol semiacetal, poly-N-vinylpyrrolidone, polyacrylic acid, polymethacrylic acid, polyacrylamide, polyvinylimidazole, and polyvinylpyrazole).

As gelatin, not only lime-processed gelatin but also acid-processed gelatin and enzyme-processed gelatin as described in *Bull. Soc. Sci. Phot. Japan,* No. 16, page 30 (1966) may be used. Further, hydrolyzed products of gelatin or enzymatically decomposed products of gelatin can also be used.

Moreover, into the color photographic light-sensitive material according to the present invention can be incorporated various kinds of stabilizers, contamination preventing agents, developing agents or precursors thereof, development accelerating agents of precursors thereof, lubricants, mordants, matting agents, antistatic agents, plasticizers, or other additives useful for photographic light-sensitive materials in addition to the above-described additives. Typical examples of these additives are described in *Research Disclosure,* RD No. 17643 (December, 1978) and ibid., RD No. 18716 (November, 1979).

The term "reflective support" which can be employed in the present invention means a support having an increased reflection property for the purpose of rendering dye images formed in the silver halide emulsion layer clear. Examples of the reflective support include a support having coated thereon a hydrophobic resin containing a light reflective substance such as titanium oxide, zinc oxide, calcium carbonate, or calcium sulfate dispersed therein and a support composed of a hydrophobic resin containing a light reflective substance dispersed therein. More specifically, they include baryta coated paper; polyethylene coated paper; polypropylene type synthetic paper; transparent supports, for example, a glass plate, a polyester film such as a polyethylene terephthalate film, a cellulose triacetate film, and a cellulose nitrate film; a polyamide film; a polycarbonate film; and a polystyrene film having a reflective layer or having incorporated therein a reflective substance. A suitable support can be appropriately selected depending on the purpose of use.

Now, the processing steps (image forming steps) which are applied to the present invention will be described in detail below.

In the present invention, the processing time for the color development step is short such as not more than 2 minutes and 30 seconds. A preferred developing time is from 10 seconds to 2 minutes. The term "processing time for a color development step" as used herein means the period of time from the time when the photographic light-sensitive material comes into contact with the color developing solution to the time when the photographic material comes into contact with the subsequent processing solution and, therefore, it includes the transfer time between the processing baths.

Aromatic primary amine color developing agents which can be used in the color developing solution according to the present invention include known compounds which are widely employed in various color photographic processes. These developing agents include aminophenol derivatives and p-phenylenediamine derivatives. Preferred examples are p-phenylenediamine derivatives. Typical examples of the p-phenylenediamine derivative used are set forth below, but the present invention should not be construed as being limited thereto.

D-1: N,N-Diethyl-p-phenylenediamine

D-2: 2-Amino-5-diethylaminotoluene

D-3: 2-Amino-5-(N-ethyl-N-laurylamino)toluene

D-4: 4-[N-Ethyl-N-(β-hydroxyethyl)amino]aniline

D-5: 2-Methyl-4-[N-ethyl-N-(β-hydroxyethyl-)amino]aniline

D-6: N-Ethyl-N-(β-methanesulfonamidoethyl)-3-methyl-4-aminoaniline

D-7: N-(2-Amino-5-diethylaminophenylethyl)methanesulfonamide

D-8: N,N-Dimethyl-p-phenylenediamine

D-9: 4-Amino-3-methyl-N-ethyl-N-methoxyethylaniline

D-10: 4-Amino-3-methyl-N-ethyl-N-β-ethoxyethylaniline

D-11: 4-Amino-3-methyl-N-ethyl-N-β-butoxyethylaniline

These p-phenylenediamine derivatives may be in the form of salts such as sulfates, hydrochlorides, sulfites, or p-toluenesulfonates. The above-described compounds are described in U.S. Pat. Nos. 2,193,015, 2,552,241, 2,566,271, 2,592,364, 3,656,950, and 3,698,525. The aromatic primary amine developing agent is used in an amount of from about 0.1 g to about 20 g and preferably from about 0.5 g to about 10 g per liter of the developing solution.

The color developing solution used in the present invention may contain hydroxylamines as is well known.

While hydroxylamines can be employed in the form of a free amine in the color developing solution, it is more general to use them in the form of a water-soluble acid salt. Examples of such salts usually used include a sulfate, an oxalate, a hydrochloride, a phosphate, a carbonate, and an acetate. Hydroxylamines may be substituted or unsubstituted. Further, the nitrogen atom in the hydroxylamine may be substituted with an alkyl group.

The amount of the hydroxylamine added is preferably from 0 g to 10 g and more preferably from 0 g to 5 g per liter of the color developing solution. It is desired that the amount of the hydroxylamine is reduced if the stability of the color developing solution can be maintained.

Also, the color developing solution used in the present invention may preferably contain sulfites such as sodium sulfite, potassium sulfite, sodium bisulfite, potassium bisulfite, sodium metasulfite, and potassium metasulfite, or carbonyl-sulfite adducts, as preservatives. The amount of these compounds added is preferably from 0 g to 20 g and more preferably from 0 g to 5 g per liter of the color developing solution. It is preferred to add these compounds in a reduced amount if the stability of the color developing solution can be maintained.

Examples of other usable preservatives include aromatic polyhydroxy compounds as described in Japanese patent application (OPI) Nos. 49828/77, 47038/81, 32140/81, and 160142/84 and U.S. Pat. No. 3,746,544; hydroxyacetones as described in U.S. Pat. No. 3,615,503 and British Pat. No. 1,306,176; α-aminocarbonyl compounds as described in Japanese patent application (OPI) Nos. 143020/77 and 89425/78; various metals as described in Japanese patent application (OPI) Nos. 44148/82 and 53749/82; various saccharides as described in Japanese patent application (OPI) No. 102727/77; hydroxamic acids as described in Japanese patent application (OPI) No. 27638/77; α,α'-dicarbonyl compounds as described in Japanese patent application (OPI) No. 160141/84; salicylic acids as described in Japanese patent application (OPI) No. 180588/84; alkanolamines as described in Japanese patent application (OPI) No. 3532/79; poly-(alkyleneimines) as described in Japanese patent application (OPI) No. 94349/81; and gluconic acid derivatives as described in Japanese patent application (OPI) No. 75647/81.

Two or more kinds of such preservatives may be employed together, if desired.

Particularly, it is preferred to add 4,5-dihydroxy-m-benzenedisulfonic acid, poly(ethyleneimine), and triethanolamine.

The color developing solution used in the present invention has a pH which ranges preferably from 9 to 12 and more preferably from 9 to 11.0. The color developing solution may also contain any of the compounds that are known to be usable as components of developing solutions.

In order to maintain the pH in the above-described range, various kinds of buffers are preferably employed. Examples of the buffer to be used include carbonates, phosphates, borates, tetraborates, hydroxybenzoates, glycine salts, N,N-dimethylglycine salts, leucine satls, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, and lysine salts. Particularly, carbonates, phosphates, tetraborates, and hydroxybenzoates are preferably employed because they have advantages in that they have good solubility and excellent buffering function in a high pH range such as pH of 9.0 or higher; they do not provide adverse effects (such as fog formation) on photographic characteristics when added to the color developing solution; and that they are inexpensive.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). The present invention should not be construed as being limited to these compounds.

The amount of the buffer to be added to the color developing solution is preferably 0.1 mol or more and more preferably from 0.1 mol to 0.4 mol per liter thereof.

In addition, various chelating agents can be used in the color developing solution according to the present invention for the purpose of preventing calcium or magnesium precipitation or increasing the stability of the color developing solution.

As chelating agents, organic acid compounds are preferred, which include, for example, aminopolycarboxylic acids as described in Japanese patent publication Nos. 30496/73 and 30232/69; organic phosphonic acids as described in Japanese patent application (OPI) No. 97347/81, Japanese patent publication No. 39359/81, and West German Pat. No. 2,227,639; phosphonocarboxylic acids as described in Japanese patent application (OPI) Nos. 102726/77, 42730/78, 121127/79, 126241/80, and 65956/80; and compounds as described in Japanese patent application (OPI) Nos.

195845/83 and 203440/83 and Japanese Patent Publication No. 40900/78.

Specific examples of the chelating agents used are set forth below, but the present invention should not be construed as being limited thereto.

Nitrilotriacetic acid
Diethyleneaminopentaacetic acid
Ethylenediaminetetraacetic acid
Triethylenetetraminehexaacetic acid
N,N,N-Trimethylenephosphonic acid
Ethylenediamine-N,N,N',N'-tetramethylenephosphonic acid
1,3-Diamino-2-propanoltetraacetic acid
Trans-cyclohexanediaminetetraacetic acid
Nitrilotripropionic acid
1,2-Diaminopropanetetraacetic acid
Hydroxyethyliminodiacetic acid
Glycol ether diaminetetraacetic acid
Hydroxyethylenediaminetriacetic acid
Ethylenediamine-o-hydroxyphenylacetic acid
2-Phosphonobutane-1,2,4-tricarboxylic acid
1-Hydroxyethane-1,1-diphosphonic acid
N,N'-Bis(2-hydroxybenzyl)ethylenediamine-N,N'-diacetic acid Two or more kinds of such chelating agents may be employed together, if desired. The chelating agent is added to the color developing solution in an amount sufficient to block metal ions present therein. For example, a range of from about 0.1 g to about 10 g per liter of the color developing solution is employed.

The color developing solution may contain appropriate development accelerators, if desired.

Examples of suitable development accelerators include thioether type compounds as described in Japanese patent publication Nos. 16088/62, 5987/62, 7826/63, 12380/69, and 9019/70 and U.S. Pat. No. 3,813,247; p-phenylenediamine type compounds as described in Japanese patent application (OPI) Nos. 49829/77 and 15554/75; quaternary ammonium salts as described in Japanese patent application (OPI) Nos. 137726/75, 156826/81, and 43429/77 and Japanese patent publication No. 30074/69; p-aminophenols as described in U.S. Pat. Nos. 2,610,122 and 4,119,462; amine type compounds as described in U.S. Pat. Nos. 2,494,903, 3,128,182, 4,230,796, 3,253,919, 2,482,546, 2,596,926 and 3,582,346 and Japanese patent publication No. 11431/66; polyalkylene oxides as described in Japanese patent publication Nos. 16088/62, 25201/67, 11431/66, and 23883/67 and U.S. Pat. Nos. 3,138,183 and 3,532,501; 1-phenyl-3-pyrazolidones; hydrazines; mesoionic compounds; thione type compounds; and imidazoles. Of these compounds, thioether type compounds and 1-phenyl-3-pyrazolidones are preferred.

The color developing solution used in the present invention may contain appropriate antifoggants, if desired. In combination with the compounds represented by formulae (I), (II), or (III), alkali metal halides such as potassium bromide, sodium chloride, and potassium iodide as well as organic antifoggants may be employed as antifoggants. Useful examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, and hydroxyazaindolizine; mercapto-substituted heterocyclic compounds, such as 2-mercaptobenzimidazole and 2-mercaptobenzothiazole, other than the compounds represented by formulae (I), (II), or (III); adenine; and mercapto-substituted aromatic compounds such as thiosalicyclic acid. These antifoggants may accumulate in the color developing solution as a result of dissolution from the color photographic light-sensitive material being processed, and it is preferred that the amount of accumulation thereof is small from the standpoint of reduction in the amount of discharge.

It is preferred that the color developing solution according to the present invention contains fluorescent brightening agents. As fluorescent brightening agents, 4,4'-diamino-2,2'-disulfostilbene type compounds are preferred. The amount of the fluorescent brightening agent added is from 0 to 5 g and preferably from 0.1 g to 2 g per liter of the color developing solution.

Furthermore, the color developing solution according to the present invention may contain various surface active agents such as alkylphosphonic acids, arylphosphonic acids, aliphatic carboxylic acids, and aromatic carboxylic acids, if desired.

The processing temperature of the color development step used in the present invention is preferably from 30° to 50° C. and more preferably from 33° to 42° C. Further, the amount of a replenisher for the color developing solution is from 30 ml to 2,000 ml and preferably from 30 ml to 1,500 ml per square meter of the color photographic light-sensitive material. It is preferred that the amount of the replenisher be small in view of reduction in the amount of discharge.

A bleaching agent used in a bleaching solution or a bleach-fixing solution employed in the present invention is preferably a ferric ion complex. The ferric ion complex is a complex of a ferric ion and a chelating agent such as an aminopolycarboxylic acid and an aminopolyphosphonic acid or a salt thereof. Salts of aminopolycarboxylic acids or aminopolyphosphonic acids are salts of an aminopolycarboxylic acid or aminopolyphosphonic acid with an alkali metal, an ammonium, or a water-soluble amine. Examples of the alkali metal include sodium, potassium, and lithium. Examples of the water-soluble amine include an alkylamine such as methylamine, diethylamine, triethylamine, and butylamine; an alicyclic amine such as cyclohexylamine; an arylamine such as aniline and m-toluidine; and a heterocyclic amine such as pyridine, morpholine, and piperidine.

Typical examples of the chelating agents such as aminopolycarboxylic acids, aminopolyphosphonic acids, or salts thereof are set forth below, but the present invention should not be construed as being limited thereto.

Ethylenediaminetetraacetic acid
Disodium ethylenediaminetetraacetate
Diammonium ethylenediaminetetraacetate
Tetra(trimethylammonium) ethylenediaminetetraacetate
Tetrapotassium ethylenediaminetetraacetate
Tetrasodium ethylenediaminetetraacetate
Trisodium ethylenediaminetraacetate
Diethylenetriaminepentaacetic acid
Pentasodium diethylenetriaminepentaacetate
Ethylenediamine-N-(β-oxyethyl)-N,N',N'-triacetic acid
Trisodium ethylenediamine-N-(β-oxyethyl)-N,N',N'-triacetate
Triammonium ethylenediamine-N-(β-oxyethyl)-N,N',N'-triacetate
Propylenediaminetetraacetic acid Disodium propylenediaminetetraacetate
Nitrilotriacetic acid
Trisodium nitrilotriacetate
Cyclohexanediaminetetraacetic acid
Disodium cyclohexanediaminetetraacetate
Iminodiacetic acid
Dihydroxyethylglycine
Ethyl ether diaminetetraacetic acid
Glycol ether diaminetetraacetic acid
Ethylenediaminetetrapropionic acid
Phenylenediaminetetraacetic acid
1,3-Diaminopropanol-N,N,N',N'-tetramethylenephosphonic acid
Ethylenediamine-N,N,N',N'-tetramethylenephosphonic acid
1,3-Propylenediamine-N,N,N',N'-tetramethylenephosphonic acid The ferric ion complex salts may be used in the form of a complex salt per se or may be formed in situ in solution by using a ferric salt (e.g., ferric sulfate, ferric chloride, ferric nitrate, ferric ammonium sulfate, or ferric phosphate) and a chelating agent (e.g., an aminopolycarboxylic acid, aminopolyphosphonic acid, or phosphonocarboxylic acid). When they are used in the form of a complex salt, they may be used alone or as a combination of two or more. On the other hand, where a complex is formed in situ in solution by using a ferric salt and a chelating agent, one or two or more ferric salts may be used. Further, one or two or more chelating agents may also be used. In every case, a chelating agent may be used in an excess amount of being necessary for forming a ferric ion complex salt.

Of the ferric ion complexes, ferric complexes of aminopolycarboxylic acids are preferred. The amount of the ferric ion complex in the bleaching solution or bleach-fixing solution is from 0.01 to 1.0 mol and preferably from 0.05 mol to 0.50 mol per liter of the solution.

In the bleaching solution or the bleach-fixing solution, a bleach accelerating agent can be used, if desired. Specific examples of suitable bleach accelerating agents include compounds having a mercapto group or a disulfide group as described in U.S. Pat. No. 3,893,858, West German Pat. Nos. 1,290,812 and 2,059,988, Japanese Patent Application (OPI) Nos. 32736/78, 57831/78, 37418/78, 65732/78, 72623/78, 95630/78, 95631/78, 104232/78, 124424/78, 141623/78, and 28426/78, and *Research Disclosure,* RD No. 17129 (July, 1978); thiazolidine derivatives as described in Japanese Patent Application (OPI) No. 14029/75; thiourea derivatives as described in Japanese Patent Publication No. 8506/70, Japanese Patent Application (OPI) Nos. 20832/77 and 32735/78, and U.S. Pat. No. 3,706,561; iodides as described in West German Pat. No. 1,127,715 and Japanese Patent Application (OPI) No. 16235/78; polyethylene oxides as described in West German Pat. Nos. 966,410 and 2,748,430; polyamine compounds as described in Japanese Patent Publication No. 8836/70; compounds as described in Japanese Patent Application (OPI) Nos. 42434/74, 59644/74, 94927/78, 35727/79, 26506/80, and 163940/83; iodine ions; and bromine ions. Of these compounds, the compounds having a mercapto group or a disulfide group are preferred in view of their large bleach accelerating effects. Particularly, the compounds as described in U.S. Pat. No. 3,893,858, West German Pat. No. 1,290,812, and Japanese Patent Application (OPI) No. 95630/78 are preferred.

The bleaching solution or bleach-fixing solution used in the present invention can contain rehalogenating agents such as bromides (e.g., potassium bromide, sodium bromide, and ammonium bromide), chlorides (e.g., potassium chloride, sodium chloride, and ammonium chloride), or iodides (e.g., ammonium iodide). Further, one or more kinds of inorganic acids, organic acids, alkali metal salts or ammonium salts thereof which have a pH buffering ability (e.g., boric acid, borax, sodium metaborate, acetic acid, sodium acetate, sodium carbonate, potassium carbonate, phosphorous acid, phosphoric acid, sodium phosphate, citric acid, sodium citrate, and tartaric acid), or corrosion preventing agents (e.g., ammonium nitrate and guanidine) may be added, if desired.

As fixing agents which can be employed in the bleach-fixing solution or fixing solution, known fixing agents, that is, water-soluble silver halide solvents such as thiosulfates (e.g., sodium thiosulfate and ammonium thiosulfate); thiocyanates (e.g., sodium thiocyanate and ammonium thiocyanate); thioether compounds (e.g., ethylenebisthioglycolic acid and 3,6-dithia-1,8-octanediol); thioureas may be used individually or as a combination of two or more. In addition, a special bleach-fixing solution comprising a combination of a fixing agent and a large amount of a halide compound such as potassium iodide as described in Japanese Patent Application (OPI) No. 155354/80 can be used as well. In the present invention, a thiosulfate, particularly ammonium thiosulfate, is preferably employed.

The amount of the fixing agent used in the bleach-fixing solution or fixing solution is preferably from 0.3 mol to 2 mol and more preferably from 0.5 mol to 1.0 mol per liter of the solution.

The pH of the bleach-fixing solution or fixing solution used in the present invention is preferably from 3 to 10 and more preferably from 4 to 9. When the pH of the bleach-fixing solution or fixing solution is lower than this value, the desilvering property is increased but it has a tendency that degradation of the solution and the formation of leuco dyes from cyan dyes are accelerated. On the contrary, when the pH is higher than this value, delayed desilvering and increase in stain are apt to occur.

In order to adjust the pH, the bleach-fixing solution or fixing solution may contain, if desired, hydrochloric acid, sulfuric acid, nitric acid, acetic acid (glacial acetic acid), a bicarbonate, ammonia, potassium hydroxide, sodium hydroxide, sodium carbonate, or potassium carbonate. Further, various kinds of fluorescent brightening agents, defoaming agents, surface active agents, polyvinyl pyrrolidone, and organic solvents (e.g., methanol) may be incorporated into the bleach-fixing solution or fixing solution.

The bleach-fixing solution or fixing solution used in the present invention can contain, as preservatives, compounds capable of releasing sulfite ions such as sulfites (e.g., sodium sulfite, potassium sulfite, and ammonium sulfite), bisulfites (e.g., ammonium bisulfite, sodium bisulfite, and potassium bisulfite), and metabisulfites (e.g., potassium metabisulfite, sodium metabisulfite, and ammonium metabisulfite). The amount of such a compound added is preferably from about 0.02 mol to about 0.50 mol and more preferably from about 0.04 mol to about 0.40 mol per liter of the solution calculated in terms of a sulfite ion.

While it is common to add sulfites as preservatives, other compounds such as ascorbic acid, a carbonylbisulfic acid adduct, and a carbonyl compound may be added.

Further, buffers, fluorescent brightening agents, chelating agents, and antimolds may be added, if desired.

A water washing step which can be utilized in the present invention will be described below.

According to the present invention, a simplified processing method, for example, a method wherein only a so-called "stabilizing process" is conducted without carrying out a substantial water washing step can be employed in place of a conventional "water washing process". The term "water washing step" as described in the present invention is used in the broad meaning as described above.

It is difficult to specify the amount of washing water used in the present invention since it can be varied depending on the number of baths employed in a multistage countercurrent water washing process and the amount of the preceding bath components carried over with the photographic light-sensitive material. However, it is sufficient for the present invention that the amount of the bleach-fixing solution components is not more than $1\times10^{-4}$ in the final water washing bath. For example, in the case of a countercurrent water washing process using three tanks, the amount of water used is preferably about 1,000 ml or more and more preferably about 5,000 ml or more per square meter of the photographic light-sensitive material. Further, it is preferred to use from 100 ml of 1,000 ml per square meter of the photographic light-sensitive material in a water saving process.

The temperature of the water washing step is in a range of from 15° C. to 45° C. and preferably from 20° C. to 35° C.

In the water washing step used in the present invention, various known compounds may be employed for the purpose of preventing the formation of precipitation or stabilizing washing water, if desired. Examples of such additives include a chelating agent such as an inorganic phosphoric acid, an aminopolycarboxylic acid, and an organic phosphonic acid; a germicidal agent or an anti-fungal agent for preventing the propagation of various bacteria, algae, and molds (e.g., the compounds as described in *J. Antibact. Antifung. Agents,* Vol. 11, No. 5, pages 207 to 223 (1983) or the compounds as described in Hiroshi Horiguchi, *Boukin Boubai no Kagaku*); a metal salt represented by a magnesium salt or an aluminum salt; an alkali metal or ammonium salt; or a surface active agent for reducing drying load or preventing drying mark. Further, the compounds as described in L. E. West, *Photo. Sci. and Eng.,* Vol. 6, pages 344 to 359 (1965) may be added thereto.

Further, the present invention is particularly effective in the case wherein the water washing step is carried out by a multistage countercurrent water washing process using two or more tanks with washing water to which a chelating agent, a germicidal agent, or an anti-fungal agent is added for the purpose of remarkably reducing the amount of washing water. Moreover, the present invention is also particularly effective in the case wherein a multistage countercurrent stabilizing step (so-called stabilizing process) as described in Japanese Patent Application (OPI) No. 8543/82 is conducted, in place of a conventional water washing step. In these cases, the amount of the bleach-fixing components in the final bath is not more than $5\times10^{-2}$ and preferably not more than $1\times10^{-2}$.

To the stabilizing bath to be used, various kinds of compounds may be added for the purpose of stabilizing images formed. Representative examples of such compounds include various buffers (for example, borates, metaborates, borax, phosphates, carbonates, potassium hydroxide, sodium hydroxide, aqueous ammonia, monocarboxylic acids, dicarboxylic acids, and polycarboxylic acids being used in a combination) in order to adjust the pH of layers (for example, to a pH of 3 to 8), and aldehydes such as formalin. In addition, various additives, for example, a chelating agent (e.g., an inorganic phosphoric acid, an aminopolycarboxylic acid, an organic phosphonic acid, an aminopolyphosphoric acid, and a phosphonocarboxylic acid), a germicidal agent (e.g., those of thiazole type, isothiazole type, halogenated phenol type, sulfanylamide type, and benzotriazole type), a surface active agent, a fluorescent brightening agent, and a hardening agent may be employed. Two or more compounds for the same purpose or different purposes may be employed together.

Further, it is preferred to add various ammonium salts such as ammonium chloride, ammonium nitrate, ammonium sulfate, ammonium phosphate, ammonium sulfite, and ammonium thiosulfate as pH adjusting agents for layers after development processing, in order to improve the image preservability.

In the case wherein the amount of washing water is widely reduced as described above, it is preferred that a part or all of the overflow from the washing water is introduced into the bleach-fixing bath or fixing bath which is the preceding bath for the purpose of reducing the amount of discharge.

Moreover, in the case of continuous processing according to the present invention, the variation of composition in each processing solution is prevented using a replenisher of each processing solution, whereby a constant finish can be achieved. The amount of the replenisher can be reduced to one half or less of the standard amount of replenishment for the purpose of reducing cost, etc.

In each of the processing baths, various kinds of a heater, a temperature sensor, a liquid level sensor, a circulation pump, a filter, a floating cover, a squeezer, a nitrogen gas stirrer, and an air stirrer may be provided, if desired.

The method according to the present invention can be applied to any processing as far as a color developing solution is employed therein. For example, it can be utilized in processing of color paper, color reversal paper, color positive films, color negative films, or color reversal films.

By practicing the present invention, it is possible to conduct a stable and rapid color image formation with high sensitivity, less fog formation, excellent image quality, and less processing alteration, particularly in the case of processing using a color developing solution which does not contain benzyl alcohol. Further, due to removing benzyl alcohol from the color developing solution, the load for prevention from an environmental pollution is remarkably reduced, and the work for preparing the processing solution is simplified. Moreover, since a rapid processing can be carried out, productivity and promptness in preparation of color prints can be extremely increased. In addition, th silver halide color photographic material and the color developing solution are employed under stable conditions.

The present invention is explained in greater detail with reference to the following examples, but the present invention should not be construed as being limited thereto.

Unless otherwise specified, all ratios, percents, etc., are by weight.

EXAMPLE 1

Silver Halide Emulsion (1) used in this example was prepared in the following manner.

Solution 1

$H_2O$: 1,000 ml
NaCl: 5.5 g
Gelatin: 32 g

Solution 2

Sulfuric acid (1N): 24 ml

Solution 3

A silver halide solvent (1%) of the 3 ml formula:

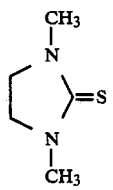

Solution 4

KBr: 15.66 g
NaCl: 3.30 g
$H_2O$ to make: 200 ml

Solution 5

$AgNO_3$: 32 g
$H_2O$ to make: 200 ml

Solution 6

KBr: 62.72 g
NaCl: 13.22 g
$K_2IrCl_6$ (0.001%): 4.54 ml
$H_2O$ to make: 600 ml

Solution 7

$AgNO_3$: 128 g
$H_2O$ to make: 600 ml solution 1 was heated at 56° C., Solution 2 and Solution 3 were added thereto and, then, Solution 4 and Solution 5 were added thereto simultaneously over a period of 30 minutes. After 10 minutes, Solution 6 and Solution 7 were added simultaneously over a period of 20 minutes. After 5 minutes, the temperature was dropped, and the mixture was desalted. Water and gelatin for dispersion were added thereto, and the pH was adjusted to 6.2 whereby a monodispersed cubic silver chlorobromide emulsion (having an average grain size of 0.45 μm, a coefficient of variation [a value obtained by dividing the standard deviation by an average grain size: $s/\bar{d}$] of 0.08, and a silver bromide content of 70 mol%) was obtained. The emulsion was subjected to an optimum chemical sensitization using sodium thiosulfate.

Further, Silver Halide Emulsions (2), (3), (4), and (5) each having a different silver chloride content were prepared in the same manner as described for Silver Halide Emulsion (1) except for changing the amounts of KBr and NaCl in Solution 4 and Solution 6 and the time for the addition of Solution 4 and Solution 5 into those as shown in Table 1 below, respectively.

TABLE 1

| Emulsion | Solution 4 KBr (g) | Solution 4 NaCl (g) | Solution 6 KBr (g) | Solution 6 NaCl (g) | Time for Addition of Solution 4 and Solution 5 (min) |
|---|---|---|---|---|---|
| (2) | 6.71 | 7.70 | 26.88 | 30.84 | 12 |
| (3) | 3.36 | 9.35 | 13.44 | 37.44 | 10 |
| (4) | 1.12 | 10.45 | 4.48 | 41.85 | 9 |
| (5) | 0.22 | 10.89 | 0.90 | 43.61 | 8 |

The average grain size, coefficient of variation, and halogen composition of each of Silver Halide Emulsions (1) to (5) are described in Table 2 below.

TABLE 2

| Emulsion | Average Grain Size (μm) | Coefficient of Variation ($s/\bar{d}$) | Halogen Composition Br (%) | Halogen Composition Cl (%) |
|---|---|---|---|---|
| (1) | 0.45 | 0.08 | 70 | 30 |
| (2) | 0.45 | 0.07 | 30 | 70 |
| (3) | 0.45 | 0.07 | 15 | 85 |
| (4) | 0.45 | 0.08 | 5 | 95 |
| (5) | 0.45 | 0.08 | 1 | 99 |

To 10.0 g of Magenta Coupler (a) and 4.1 g of Color Image Stabilizer (b) were added 13.6 mol of ethyl acetate and 10.0 ml of Solvent (c), and the components were dissolved. The resulting solution was dispersed in 150 ml of a 10% aqueous solution of gelatin containing 5.5 ml of a 10% aqueous solution of sodium dodecylbenzenesulfonate.

To each of Emulsions (1) to (5) described above was added $4.0\times10^{-4}$ mol of Green-Sensitive Sensitizing Dye (d) shown below per mol of the silver halide to prepare green-sensitive emulsions. Using these green-sensitive emulsions, the above-described coupler dispersion and Additives (e) to (i) shown below in combination, Samples 1 to 19 shown in Table 3 below were prepared, respectively.

As a support, a paper support, both surfaces of which were laminated with polyethylene was used. The coating amounts of silver, coupler, and gelatin were adjusted so as to be 0.15 g/m², 0.38 g/m², and 1.80 g/m², respectively. On the emulsion layer, a protective layer was provided so as to be 1.50 g/m² of gelatin.

Further, to each layer was added 1-oxy-3,5-dichloro-s-triazine sodium salt as a gelatin hardening agent.

Magenta Coupler (a):

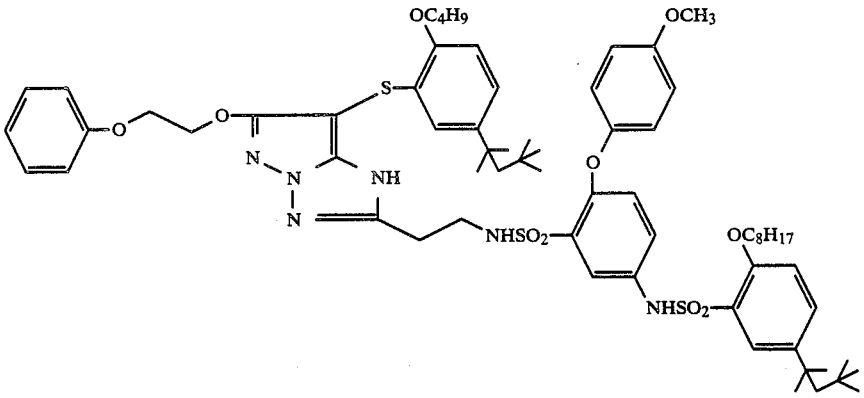

Color Image Stabilizer (b):

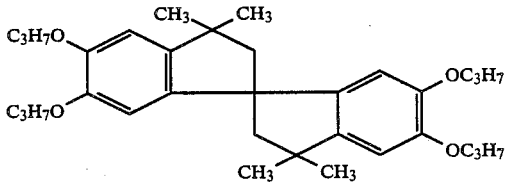

Solvent (c):

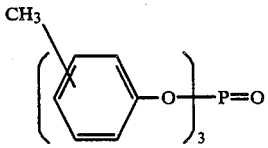

Sensitizing Dye (d):

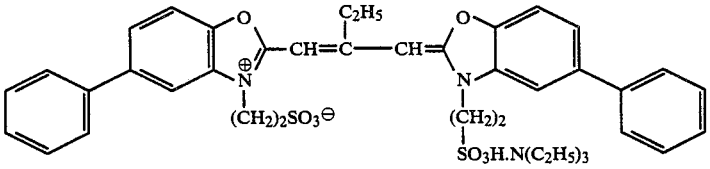

Comparative Additive (e):

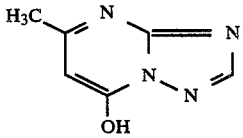

Additive of Present Invention (f):

Compound (I-52)

Additive of Present Invention (g):

Compound (III-9)

Additive of Present Invention (h):

Compound (II-1)

Additive of Present Invention (i):

Compound (I-45)

TABLE 3

| Sample No. | Emulsion | Compound Added: Kind | Compound Added: Amount Added (mol/mol AgX) |
|---|---|---|---|
| 1 | (1) | — | — |
| 2 | (2) | — | — |
| 3 | (3) | — | — |
| 4 | (4) | — | — |
| 5 | (5) | — | — |
| 6 | (5) | (e) (Comparison) | $5 \times 10^{-3}$ |
| 7 | (5) | (f) | $5 \times 10^{-4}$ |
| 8 | (5) | (g) | $5 \times 10^{-4}$ |
| 9 | (3) | (f) | $5 \times 10^{-4}$ |
| 10 | (1) | (h) | $5 \times 10^{-4}$ |
| 11 | (2) | (h) | $5 \times 10^{-4}$ |
| 12 | (3) | (h) | $5 \times 10^{-4}$ |
| 13 | (4) | (h) | $5 \times 10^{-4}$ |
| 14 | (5) | (h) | $5 \times 10^{-4}$ |
| 15 | (1) | (i) | $5 \times 10^{-4}$ |
| 16 | (2) | (i) | $5 \times 10^{-4}$ |
| 17 | (3) | (i) | $5 \times 10^{-4}$ |
| 18 | (4) | (i) | $5 \times 10^{-4}$ |
| 19 | (5) | (i) | $5 \times 10^{-4}$ |

Samples (1) to (19) thus prepared were subjected to stepwise exposure for sensitometry through a green filter using a sensitometer (FWH type manufactured by Fuji Photo Film Co., Ltd.; color temperature of light source: 3,200° K.). The exposure was conducted at an exposure time of 0.5 second in an exposure amount of 250 CMS.

The exposed samples were then processed according to Processings A, B, and C using Color Developing Solutions (A), (B), and (C) as shown below, respectively.

The processings each consisted of a color development step, a bleach-fixing step, and a rinse step. In Processing A, the development time was 3 minutes and 30 seconds, and this was used as a standard in order to evaluate the effect of the present invention. With respect to Processings B and C, the development time was altered for 30 seconds, 45 seconds, or 60 seconds to evaluate the photographic properties.

The conditions of Processings A, B, and C and the compositions of the processing solutions used therefor are shown below.

The evaluation of photographic properties was conducted using three factors, i.e., fog density (Dmin), relative sensitivity, and color forming property. The relative sensitivity is illustrated using the result obtained from Processing A with the development time of 3 minutes and 30 seconds as the standard value. More specifically, the sensitivity is shown by a reciprocal of the exposure amount required for obtaining an optical density of fog density +0.5, and the sensitivity of each sample processed with Processing A is taken as 100 and the other sensitivities obtained from other proceedings are shown relatively.

Further, rapidity of the development was evaluated using the result obtained from Processing A with the development time of 3 minutes and 30 seconds as the standard value. More specifically, the exposure amount required for obtaining a color density of 1.50 using Processing A with the development time of 3 minutes and 30 seconds in each sample, and color densities at this exposure amount obtained in other processings were determined to evaluate the color forming property.

The results thus-obtained are shown in Table 4 below.

| Processing Step | Temperature (°C.) | Time |
|---|---|---|
| Color Development | | |
| Processing A | 33 | 3 min 30 sec |
| Processing B | 35 | 30 sec, 45 sec, or 60 sec |
| Processing C | 35 | 30 sec, 45 sec, or 60 sec |
| Bleach-Fixing | | |
| Processing A | 33 | 1 min 30 sec |
| Processing B | 35 | 45 sec |
| Processing C | 35 | 45 sec |
| Rinse | 28 to 35 | 1 min 30 sec |

Compositions of Color Developing Solutions

Color Developing Solution (A):
Pentasodium Diethylenetriaminepentaacetate: 2.0 g
Benzyl Alcohol: 15 ml
Diethylene Glycol: 10 ml
$Na_2SO_3$: 2.0 g
KBr: 1.0 g
Hydroxylamine Sulfate: 3.0 g
4-Amino-3-methyl-N-ethyl-N-[β-(methanesulfonamido)ethyl]-p-phenylenediamine Sulfate: 5.0 g
$Na_2CO_3$ (monohydrate): 30.0 g
Fluorescent Whitening Agent (stilbene type): 1.0 g
Water to make: 1,000 ml; pH 10.2

Color Developing Solution (B):
Water: 800 ml
Diethylenetriaminepentaacetic Acid: 1.0 g
Sodium Sulfite: 0.2 g
N,N-Diethylhydroxylamine: 4.2 g
Potassium Bromide: 0.6 g
Sodium Chloride: 1.5 g
Triethanolamine: 8.0 g
Potassium Carbonate: 30 g
N-Ethyl-N-(β-methanesulfonamidoethyl)-3-methyl-4-aminoaniline Sulfate: 4.5 g
4,4'-Diaminostilbene Type Fluorescent Whitening Agent (Whitex 4 manufactured by Sumitomo Chemical Co., Ltd.): 2.0 g
Water to make: 1,000 ml
Adjusted pH to 10.25 with KOH Color Developing Solution (C):
Water: 800 ml
Diethylenetriaminepentaacetic Acid: 1.0 g
Sodium Sulfite: 0.2 g
N,N-Diethylhydroxylamine: 4.2 g
Potassium Bromide: 0.01 g
Sodium Chloride: 1.5 g
Triethanolamine: 8.0 g
Potassium Carbonate: 30 g
N-Ethyl-N-(β-methanesulfonamidoethyl)-3-methyl-4-aminoaniline Sulfate: 4.5 g
4,4'-Diaminostilbene Type Fluorescent Whitening Agent (Whitex 4 manufactured by Sumitomo Chemical Co., Ltd.): 2.0 g
Water to make: 1,000 ml
Adjusted pH to 10.25 with KOH Bleach-Fixing Solution:
Ammonium Thiosulfate (54% by weight aq. soln.): 150 ml
$Na_2SO_3$: 15 g
$NH_4[Fe(III)(EDTA)]$: 55 g
EDTA·2Na: 4 g
Glacial Acetic Acid: 8.61 g
Water to make: 1,000 ml; pH 5.4

Rinse Solution:
EDTA·2Na·$2H_2O$: 0.4 g
Water to make: 1,000 ml; pH 7.0

TABLE 4

| Sample No. | Processing Time | Processing A $D_{min}$ | Processing A Relative Sensitivity | Processing A Color Forming Property | Processing Time | Processing B $D_{min}$ | Processing B Relative Sensitivity | Processing B Color Forming Property | Processing C $D_{min}$ | Processing C Relative Sensitivity | Processing C Color Forming Property |
|---|---|---|---|---|---|---|---|---|---|---|---|
| 1 | 3 min 30 sec | 0.10 | 100 | 1.5 | 30 sec | 0.90 | 54 | 0.65 | 0.10 | 75 | 1.17 |
| | | | | | 45 sec | 0.10 | 62 | 0.89 | 0.10 | 92 | 1.38 |
| | | | | | 60 sec | 0.10 | 78 | 1.19 | 0.10 | 101 | 1.48 |
| 2 | 3 min 30 sec | 0.10 | 100 | 1.5 | 30 sec | 0.10 | 57 | 0.85 | 0.10 | 81 | 1.28 |
| | | | | | 45 sec | 0.10 | 72 | 1.06 | 0.10 | 95 | 1.28 |
| | | | | | 60 sec | 0.10 | 83 | 1.30 | 0.10 | 108 | 1.42 |
| 3 | 3 min 30 sec | 0.10 | 100 | 1.5 | 30 sec | 0.10 | 68 | 0.96 | 0.10 | 96 | 1.38 |
| | | | | | 45 sec | 0.10 | 79 | 1.20 | 0.11 | 103 | 1.45 |
| | | | | | 60 sec | 0.10 | 96 | 1.37 | 0.13 | 113 | 1.55 |
| 4 | 3 min 30 sec | 0.12 | 100 | 1.5 | 30 sec | 0.10 | 78 | 1.14 | 0.10 | 101 | 1.48 |
| | | | | | 45 sec | 0.10 | 95 | 1.36 | 0.11 | 108 | 1.52 |
| | | | | | 60 sec | 0.11 | 100 | 1.49 | 0.14 | 113 | 1.62 |
| 5 | 3 min 30 sec | 0.16 | 100 | 1.5 | 30 sec | 0.10 | 89 | 1.38 | 0.10 | 104 | 1.57 |
| | | | | | 45 sec | 0.10 | 97 | 1.43 | 0.13 | 109 | 1.64 |
| | | | | | 60 sec | 0.14 | 103 | 1.56 | 0.16 | 114 | 1.69 |

TABLE 4-continued

| Sample No. | Processing Time | Processing A $D_{min}$ | Processing A Relative Sensitivity | Processing A Color Forming Property | Processing Time | Processing B $D_{min}$ | Processing B Relative Sensitivity | Processing B Color Forming Property | Processing C $D_{min}$ | Processing C Relative Sensitivity | Processing C Color Forming Property |
|---|---|---|---|---|---|---|---|---|---|---|---|
| 6 | 3 min 30 sec | 0.12 | 100 | 1.5 | 30 sec | 0.10 | 103 | 1.55 | | | |
| | | | | | 45 sec | 0.10 | 96 | 1.40 | 0.12 | 108 | 1.62 |
| | | | | | 60 sec | 0.14 | 102 | 1.54 | 0.16 | 115 | 1.70 |
| 7 | 3 min 30 sec | 0.10 | 100 | 1.5 | 30 sec | 0.10 | 91 | 1.37 | 0.10 | 116 | 1.55 |
| | | | | | 45 sec | 0.10 | 100 | 1.42 | 0.10 | 119 | 1.62 |
| | | | | | 60 sec | 0.10 | 115 | 1.55 | 0.11 | 124 | 1.65 |
| 8 | 3 min 30 sec | 0.10 | 100 | 1.5 | 30 sec | 0.10 | 89 | 1.34 | 0.10 | 114 | 1.54 |
| | | | | | 45 sec | 0.10 | 97 | 1.41 | 0.10 | 117 | 1.61 |
| | | | | | 60 sec | 0.10 | 113 | 1.53 | 0.12 | 123 | 1.65 |
| 9 | 3 min 30 sec | 0.10 | 100 | 1.5 | 30 sec | 0.10 | 62 | 0.93 | 0.10 | 99 | 1.38 |
| | | | | | 45 sec | 0.10 | 73 | 1.03 | 0.10 | 106 | 1.47 |
| | | | | | 60 sec | 0.10 | 97 | 1.39 | 0.10 | 111 | 1.52 |
| 10 | 3 min 30 sec | 0.10 | 100 | 1.5 | 30 sec | 0.10 | 51 | 0.58 | 0.10 | 73 | 1.25 |
| | | | | | 45 sec | 0.10 | 58 | 0.78 | 0.10 | 91 | 1.40 |
| | | | | | 60 sec | 0.10 | 71 | 1.01 | 0.10 | 99 | 1.47 |
| 11 | 3 min 30 sec | 0.10 | 100 | 1.5 | 30 sec | 0.10 | 53 | 0.62 | 0.10 | 86 | 1.32 |
| | | | | | 45 sec | 0.10 | 67 | 0.99 | 0.10 | 98 | 1.44 |
| | | | | | 60 sec | 0.10 | 81 | 1.28 | 0.10 | 105 | 1.50 |
| 12 | 3 min 30 sec | 0.10 | 100 | 1.5 | 30 sec | 0.10 | 65 | 0.94 | 0.10 | 98 | 1.38 |
| | | | | | 45 sec | 0.10 | 78 | 1.18 | 0.10 | 106 | 1.47 |
| | | | | | 60 sec | 0.10 | 95 | 1.34 | 0.10 | 112 | 1.52 |
| 13 | 3 min 30 sec | 0.10 | 100 | 1.5 | 30 sec | 0.10 | 76 | 1.12 | 0.10 | 107 | 1.47 |
| | | | | | 45 sec | 0.10 | 93 | 1.33 | 0.10 | 113 | 1.55 |
| | | | | | 60 sec | 0.10 | 99 | 1.47 | 0.10 | 119 | 1.60 |
| 14 | 3 min 30 sec | 0.10 | 100 | 1.5 | 30 sec | 0.10 | 88 | 1.37 | 0.10 | 116 | 1.55 |
| | | | | | 45 sec | 0.10 | 97 | 1.42 | 0.10 | 119 | 1.63 |
| | | | | | 60 sec | 0.10 | 102 | 1.55 | 0.10 | 124 | 1.66 |
| 15 | 3 min 30 sec | 0.10 | 100 | 1.5 | 30 sec | 0.10 | 53 | 0.61 | 0.10 | 75 | 1.26 |
| | | | | | 45 sec | 0.10 | 59 | 0.82 | 0.10 | 94 | 1.42 |
| | | | | | 60 sec | 0.10 | 75 | 1.11 | 0.10 | 103 | 1.50 |
| 16 | 3 min 30 sec | 0.10 | 100 | 1.5 | 30 sec | 0.10 | 56 | 0.78 | 0.10 | 88 | 1.33 |
| | | | | | 45 sec | 0.10 | 70 | 1.02 | 0.10 | 101 | 1.45 |
| | | | | | 60 sec | 0.10 | 82 | 1.28 | 0.10 | 109 | 1.52 |
| 17 | 3 min 30 sec | 0.10 | 100 | 1.5 | 30 sec | 0.10 | 67 | 0.95 | 0.10 | 101 | 1.41 |
| | | | | | 45 sec | 0.10 | 78 | 1.19 | 0.10 | 109 | 1.49 |
| | | | | | 60 sec | 0.10 | 95 | 1.34 | 0.10 | 115 | 1.53 |
| 18 | 3 min 30 sec | 0.10 | 100 | 1.5 | 30 sec | 0.10 | 77 | 1.13 | 0.10 | 109 | 1.49 |
| | | | | | 45 sec | 0.10 | 94 | 1.35 | 0.10 | 116 | 1.57 |
| | | | | | 60 sec | 0.10 | 100 | 1.48 | 0.10 | 122 | 1.62 |
| 19 | 3 min 30 sec | 0.10 | 100 | 1.5 | 30 sec | 0.10 | 89 | 1.38 | 0.10 | 119 | 1.57 |
| | | | | | 45 sec | 0.10 | 97 | 1.43 | 0.10 | 122 | 1.66 |
| | | | | | 60 sec | 0.10 | 103 | 1.57 | 0.10 | 128 | 1.68 |

The values surrounded by squares in Table 4 denote the results according to the present invention.

From the results shown in Table 4, it is apparent that high color densities can be obtained without an increase in fog according to the present invention even when a rapid processing is carried out using a color developing solution which does not contain benzyl alcohol. Further, when the results with respect to Samples 5, 6, 7, 8, 14, and 19 are compared, it can be seen that the formation of fog is effectively reduced and that changes in the photographic properties are less in the rapid processing using the color developing solution which contains not more than 0.002 mol of potassium bromide per liter and substantially no benzyl alcohol owing to the use of the compound represented by formulae (I), (II), or (III) according to the present invention. These effects cannot be obtained in the case of using the hitherto known stabilizer as illustrated with Sample 6 and are novel and completely unexpected.

EXAMPLE 2

Silver Halide Emulsion (6) used in this example was prepared in the following manner.

Solution 8

$H_2O$: 1,000 ml
NaCl: 5.5 g
Gelatin: 32 g

Solution 9

Sulfuric Acid (1N): 20 ml

Solution 10

A silver halide solvent (1%) of the formula: 3 ml and the times for the additions of Solution 11 and Solution 12 and Solution (13) and Solution 14 to those as described in Table 5 and Table 6, respectively.

TABLE 5

| | Solution 11 | | | Solution 12 | | | Time for Addition |
|---|---|---|---|---|---|---|---|
| Emulsion | KBr | NaCl | $H_2O$ to make | $AgNO_3$ | $NH_4NO_3$(50%) | $H_2O$ to make | of Solution 11 and Solution 12 |
| (7) | 2.63 g | 7.31 g | 130 ml | 25 g | 0.5 ml | 130 ml | 60 min. |
| (8) | 0.18 g | 8.51 g | 130 ml | 25 g | 0.5 ml | 130 ml | 60 min |

TABLE 6

| | Solution 13 | | | | Solution 14 | | | Time for Addition |
|---|---|---|---|---|---|---|---|---|
| Emulsion | KBr | NaCl | $K_2IrCl_6$ (0.001%) | $H_2O$ to make | $AgNO_3$ | $NH_4NO_3$ (50%) | $H_2O$ to make | of Solution 11 and Solution 12 |
| (7) | 10.51 g | 29.24 g | 0.7 cc | 285 cc | 100 g | 2.0 cc | 285 cc | 25 min |
| (8) | 0.70 g | 34.06 g | 0.7 cc | 285 cc | 100 g | 2.0 cc | 285 cc | 25 min |

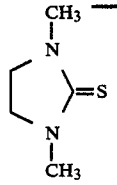

Solution 11

KBr: 2.45 g
NaCl: 0.52 g
$H_2O$ to make: 140 ml

Solution 12

$AgNO_3$: 5 g
$H_2O$ to make: 140 ml

Solution 13

KBr: 58.80 g
NaCl: 12.39 g
$K_2IrCl_6$ (0.001%): 0.7 ml
$H_2O$ to make: 320 ml

Solution 14

$AgNO_3$: 120 g
$H_2O$ to make: 320 ml

Solution 8 was heated at 75° C., Solution 9 and Solution 10 were added thereto and, then, Solution 11 and Solution 12 were added thereto simultaneously over a period of 9 minutes. After 10 minutes, Solution 13 and Solution 14 were added simultaneously over a period of 45 minutes. After 5 minutes, the temperature was dropped, and the mixture was desalted. Water and gelatin for dispersion were added thereto, and the pH was adjusted to 6.2, whereby a monodispersed cubic silver chlorobromide emulsion (having an average grain size of 1.01 μm, a coefficient of variation [a value obtained by dividing the standard deviation by an average grain size: $s/\bar{d}$] of 0.08, and a silver bromide content of 70 mol%) was obtained. The emulsion was subjected to an optimum chemical sensitization using sodium thiosulfate.

Further, Silver Halide Emulsions (7) and (8) each having a different silver chloride content were prepared in the same manner as described for Silver Halide Emulsion (6) except for changing the temperature of Solution 8 to 62° C., and the compositions of Solutions 11 to 14

The average grain size, coefficient of variation, and halogen composition of each of Silver Halide Emulsions (6) to (8) are set forth in Table 7 below.

TABLE 7

| Emulsion | Average Grain Size (μm) | Coefficient of Variation ($s/\bar{d}$) | Halogen Composition Br (%) | Halogen Composition Cl (%) |
|---|---|---|---|---|
| (6) | 1.01 | 0.08 | 70 | 30 |
| (7) | 1.01 | 0.07 | 15 | 85 |
| (8) | 1.02 | 0.08 | 1 | 99 |

In the same manner as described in Example 1, using Silver Halide Emulsions (1), (3), (5), (6), (7), and (8), dispersions of color couplers shown below and the additives according to the present invention in combination, Samples 20 to 26 shown in Table 8 and Table 9 were prepared, respectively. To the emulsion for a blue-sensitive layer was added $7.0\times10^{-4}$ mol of Sensitizing Dye (m) shown below per mol of the silver halide, and to the emulsion for a red-sensitive layer was added $1.0\times10^{-4}$ mol of Sensitizing Dye (v) shown below per mol of the silver halide. To the emulsion for a green-sensitive layer was added the same sensitizing dye in the same amount as described in Example 1. Further, irradiation preventing dyes shown below were employed in the emulsion layer respectively. A gelatin hardening agent used in each layer was the same as described in Example 1.

Irradiation Prevenring Dye for Green-Sensitive Emulsion Layer:

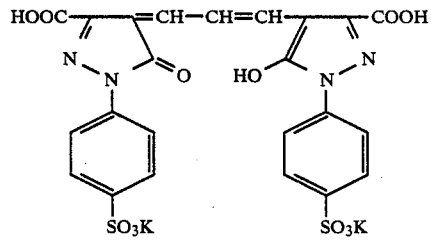

Irradiation Preventing Dye for Red-Sensitive Emulsion Layer:

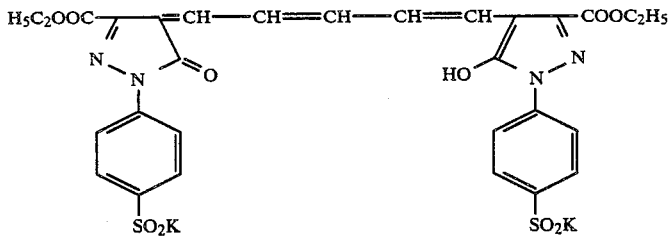
Yellow Coupler (j):
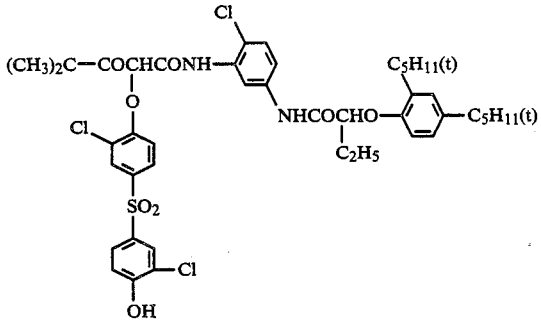
Color Image Stabilizer (k):
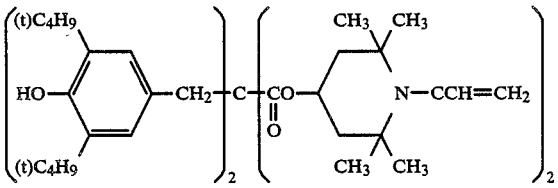
Solvent (l):
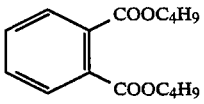
Blue-Sensitive Sensitizing Dye (m):
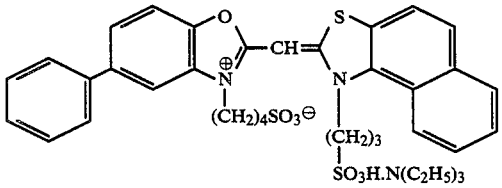
Color Mixing Preventing Agent (n):
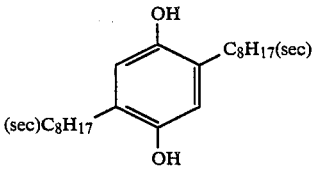
Magenta Coupler (o):
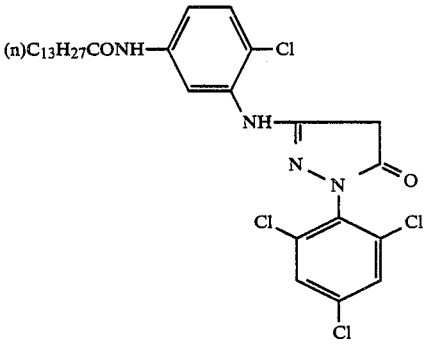
Color Fading Preventing Agent (p):
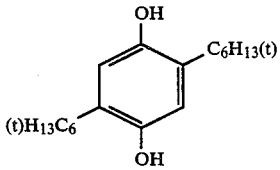
Ultraviolet Light Absorbing Agent (q):
A mixture of
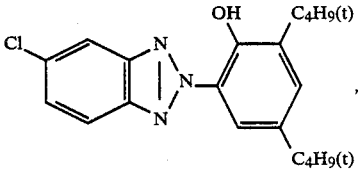
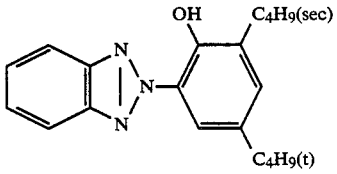
and
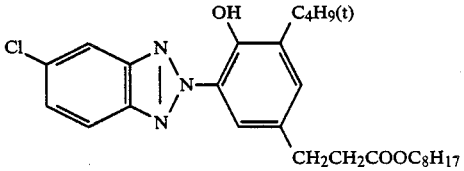
in a molar ratio of 1:5:3
Color Mixing Preventing Agent (r):

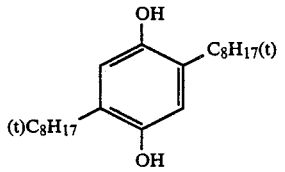

Solvent (s):

$(iso\text{-}C_9H_{18}O)_3P{=}O$

Cyan Coupler (t):

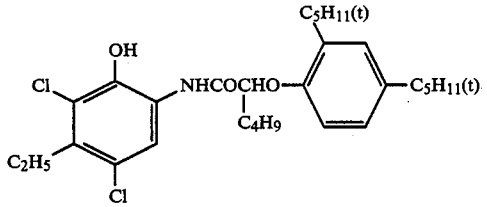

Color Image Stabilizer (u):

A mixture of

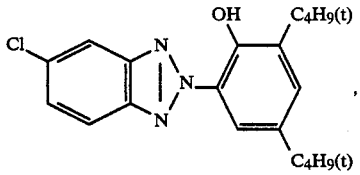

-continued

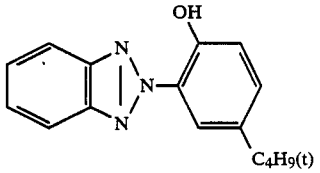

and

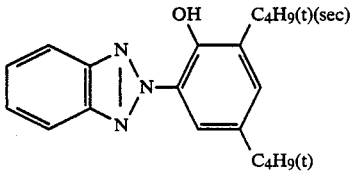

in a molar ratio of 1:3:3

Red-Sensitive Sensitizing Dye (v):

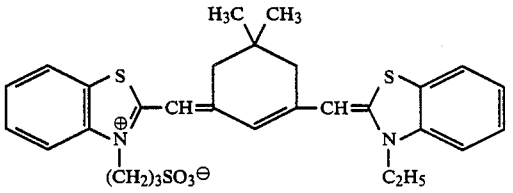

TABLE 8

| Layer | Main Composition | Amount Used |
|---|---|---|
| (Seventh Layer) (Protective layer) | Gelatin | 1.33 g/m$^2$ |
| | Acryl-modified Polyvinyl Alcohol Copolymer (degree of modification: 17%) | 0.17 g/m$^2$ |
| Sixth Layer (Ultraviolet light absorbing layer) | Gelatin | 0.54 g/m$^2$ |
| | Ultraviolet Light Absorbing Agent (g) | 0.21 g/m$^2$ |
| | Solvent (s) | 0.09 ml/m$^2$ |
| Fifth Layer (Red-sensitive layer) | Silver Halide Emulsion (shown in Table 9) | 0.22 g/m$^2$ (as silver) |
| | Gelatin | 0.90 g/m$^2$ |
| | Cyan Coupler (t) | 0.36 g/m$^2$ |
| | Color Image Stabilizer (u) | 0.17 g/m$^2$ |
| | Solvent (l) | 0.22 ml/m$^2$ |
| Fourth Layer (Ultraviolet light absorbing layer) | Gelatin | 1.60 g/m$^2$ |
| | Ultraviolet Light Absorbing Agent (q) | 0.62 g/m$^2$ |
| | Color Mixing Preventing Agent (r) | 0.05 g/m$^2$ |
| | Solvent (s) | 0.26 ml/m$^2$ |
| Third Layer (Green-sensitive layer) | Silver Halide Emulsion (shown in Table 9) | 0.15 g/m$^2$ (as silver) |
| | Gelatin | 1.80 g/m$^2$ |
| | Magenta Coupler (a) | 0.38 g/m$^2$ |
| | Color Image Stabilizer (b) | 0.16 g/m$^2$ |
| | Solvent (c) | 0.38 ml/m$^2$ |
| Second Layer (Color mixing preventing layer) | Gelatin | 0.99 g/m$^2$ |
| | Color Mixing Preventing Agent (n) | 0.08 g/m$^2$ |
| First Layer (Blue-sensitive layer) | Silver Halide Emulsion (shown in Table 9) | 0.26 g/m$^2$ (as silver) |
| | Gelatin | 1.83 g/m$^2$ |
| | Yellow Coupler (j) | 0.91 g/m$^2$ |
| | Color Image Stabilizer (k) | 0.19 g/m$^2$ |
| | Solvent (l) | 0.36 ml/m$^2$ |
| Support | Polyethylene laminated paper (the polyethylene coating containing a white pigment ($TiO_2$) and a bluish dye | |

TABLE 8-continued

| Layer | Main Composition | Amount Used |
|---|---|---|
| | (ultramarine) | on the first layer side). |

The silver halide emulsions used in the light-sensitive emulsion layers and the additives are shown in Table 9 below.

TABLE 9

| | | First Layer | Second Layer | Third Layer | Fourth Layer | Fifth Layer | Sixth Layer | Seventh Layer |
|---|---|---|---|---|---|---|---|---|
| Sample 20 | Silver Halide Emulsion | (6) | — | (1) | — | (1) | — | — |
| | Additive | (i) 0.302 | — | (i) 0.174 | — | (i) 0.255 | — | — |
| Sample 21 | Silver Halide Emulsion | (6) | — | (1) | — | (1) | — | — |
| | Additive | — | — | — | — | — | — | — |
| Sample 22 | Silver Halide Emulsion | (7) | — | (3) | — | (3) | — | — |
| | Additive | (i) 0.302 | — | (i) 0.174 | — | (i) 0.255 | — | — |
| Sample 23 | Silver Halide Emulsion | (7) | — | (3) | — | (3) | — | — |
| | Additive | — | — | — | — | — | — | — |
| Sample 24 | Silver Halide Emulsion | (8) | — | (5) | — | (5) | — | — |
| | Additive | (i) 0.302 | — | (i) 0.174 | — | (i) 0.255 | — | — |
| Sample 25 | Silver Halide Emulsion | (8) | — | (5) | — | (5) | — | — |
| | Additive | — | — | — | — | — | — | — |
| Sample 26 | Silver Halide Emulsion | (8) | — | (5) | — | (5) | — | — |
| | Additive | — | (i) 0.389 | — | (i) 0.342 | — | — | — |

The amount of the additive is indicated in a unit of mg/m$^2$.

Further, Sample 27 was prepared in the same manner as in Sample 24 except for changing he compositions of the third layer to those shown in Table 10 below. Moreover, Sample 28 was prepared in the same manner as in Sample 24 except for changing the coating amounts of the silver halide emulsions in the light-sensitive emulsion layers to those shown in Table 11.

TABLE 10

| | Main Composition | Amount Used |
|---|---|---|
| Third Layer of Sample 27 | Silver Halide Emulsion (5) | 0.27 g/m$^2$ (as silver) |
| | Gelatin | 1.00 g/m$^2$ |

TABLE 10-continued

| Main Composition | Amount Used |
|---|---|
| Magenta Coupler (o) | 0.31 g/m$^2$ |
| Color Image Stabilizer (p/b) | 0.01/0.26 g/m$^2$ |
| Solvent (l) | 0.32 ml/m$^2$ |

TABLE 11

| | First Layer | Third Layer | Fifth Layer |
|---|---|---|---|
| Coating Amount of Silver Halide Emulsion | 0.35 g/m$^2$ | 0.20 g/m$^2$ | 0.30 g/m$^2$ |

With respect to these samples thus prepared the same procedure as described in Example 1 was conducted using Processings A and C. The results thus obtained are shown in Table 12 below.

TABLE 12

| Sample No. | Layer | Processing Time | Processing A $D_{min}$ | Processing A Relative Sensitivity | Processing A Color Forming Property | Processing Time | Processing C $D_{min}$ | Processing C Relative Sensitivity | Processing C Color Forming Property | Coating amount of Silver |
|---|---|---|---|---|---|---|---|---|---|---|
| 20 | B | 3 min 30 sec | 0.08 | 100 | 1.50 | 30 sec | 0.08 | 30 | 0.52 | |
| | | | | | | 45 sec | 0.08 | 62 | 0.68 | |
| | | | | | | 60 sec | 0.08 | 85 | 1.11 | |
| | G | 3 min 30 sec | 0.10 | 100 | 1.50 | 30 sec | 0.10 | 72 | 1.24 | 0.63 g/m$^2$ |
| | | | | | | 45 sec | 0.10 | 89 | 1.39 | |
| | | | | | | 60 sec | 0.10 | 98 | 1.47 | |
| | R | 3 min 30 sec | 0.11 | 100 | 1.50 | 30 sec | 0.11 | 68 | 1.16 | |
| | | | | | | 45 sec | 0.11 | 79 | 1.25 | |
| | | | | | | 60 sec | 0.11 | 85 | 1.33 | |
| 21 | B | 3 min 30 sec | 0.08 | 100 | 1.50 | 30 sec | 0.08 | 41 | 0.58 | |
| | | | | | | 45 sec | 0.08 | 68 | 0.77 | |
| | | | | | | 60 sec | 0.08 | 93 | 1.22 | |
| | G | 3 min 30 sec | 0.10 | 100 | 1.50 | 30 sec | 0.10 | 74 | 1.16 | 0.63 g/m$^2$ |
| | | | | | | 45 sec | 0.10 | 93 | 1.39 | |
| | | | | | | 60 sec | 0.10 | 102 | 1.49 | |
| | R | 3 min 30 sec | 0.11 | 100 | 1.50 | 30 sec | 0.11 | 68 | 1.14 | |
| | | | | | | 45 sec | 0.11 | 83 | 1.34 | |
| | | | | | | 60 sec | 0.11 | 93 | 1.43 | |
| 22 | B | 3 min 30 sec | 0.08 | 100 | 1.50 | 30 sec | 0.07 | 78 | 1.23 | |
| | | | | | | 45 sec | 0.07 | 102 | 1.46 | |
| | | | | | | 60 sec | 0.07 | 115 | 1.60 | |
| | G | 3 min 30 sec | 0.10 | 100 | 1.50 | 30 sec | 0.10 | 98 | 1.38 | 0.63 g/m$^2$ |
| | | | | | | 45 sec | 0.10 | 105 | 1.46 | |
| | | | | | | 60 sec | 0.10 | 110 | 1.51 | |
| | R | 3 min 30 sec | 0.11 | 100 | 1.50 | 30 sec | 0.11 | 100 | 1.40 | |
| | | | | | | 45 sec | 0.11 | 107 | 1.50 | |
| | | | | | | 60 sec | 0.11 | 112 | 1.57 | |

TABLE 12-continued

| Sample No. | Layer | Processing Time | Processing A $D_{min}$ | Processing A Relative Sensitivity | Processing A Color Forming Property | Processing Time | Processing C $D_{min}$ | Processing C Relative Sensitivity | Processing C Color Forming Property | Coating amount of Silver |
|---|---|---|---|---|---|---|---|---|---|---|
| 23 | B | 3 min 30 sec | 0.08 | 100 | 1.50 | 30 sec | 0.08 | 79 | 1.26 | |
| | | | | | | 45 sec | 0.08 | 100 | 1.45 | |
| | | | | | | 60 sec | 0.09 | 123 | 1.59 | |
| | G | 3 min 30 sec | 0.10 | 100 | 1.50 | 30 sec | 0.10 | 95 | 1.37 | |
| | | | | | | 45 sec. | 0.11 | 102 | 1.44 | 0.63 g/m² |
| | | | | | | 60 sec | 0.11 | 112 | 1.53 | |
| | R | 3 min 30 sec | 0.11 | 100 | 1.50 | 30 sec | 0.11 | 95 | 1.37 | |
| | | | | | | 45 sec | 0.11 | 102 | 1.48 | |
| | | | | | | 60 sec | 0.12 | 110 | 1.59 | |
| 24 | B | 3 min 30 sec | 0.07 | 100 | 1.50 | 30 sec | 0.07 | 105 | 1.52 | |
| | | | | | | 45 sec | 0.07 | 115 | 1.60 | |
| | | | | | | 60 sec | 0.07 | 123 | 1.65 | |
| | G | 3 min 30 sec | 0.10 | 100 | 1.50 | 30 sec | 0.09 | 115 | 1.55 | |
| | | | | | | 45 sec | 0.09 | 118 | 1.61 | 0.63 g/m² |
| | | | | | | 60 sec | 0.09 | 123 | 1.65 | |
| | R | 3 min 30 sec | 0.11 | 100 | 1.50 | 30 sec | 0.11 | 115 | 1.62 | |
| | | | | | | 45 sec | 0.11 | 120 | 1.68 | |
| | | | | | | 60 sec | 0.11 | 126 | 1.78 | |
| 25 | B | 3 min 30 sec | 0.07 | 100 | 1.50 | 30 sec | 0.09 | 5 | 1.53 | |
| | | | | | | 45 sec | 0.11 | 105 | 1.59 | |
| | | | | | | 60 sec | 0.14 | 115 | 1.68 | |
| | G | 3 min 30 sec | 0.10 | 100 | 1.50 | 30 sec | 0.10 | 102 | 1.55 | |
| | | | | | | 45 sec | 0.12 | 107 | 1.62 | 0.63 g/m² |
| | | | | | | 60 sec | 0.15 | 112 | 1.68 | |
| | R | 3 min 30 sec | 0.11 | 100 | 1.50 | 30 sec | 0.12 | 102 | 1.49 | |
| | | | | | | 45 sec | 0.13 | 107 | 1.57 | |
| | | | | | | 60 sec | 0.14 | 117 | 1.73 | |
| 26 | B | 3 min 30 sec | 0.08 | 100 | 1.50 | 30 sec | 0.09 | 107 | 1.56 | |
| | | | | | | 45 sec | 0.09 | 118 | 1.62 | |
| | | | | | | 60 sec | 0.09 | 123 | 1.65 | |
| | G | 3 min 30 sec | 0.10 | 100 | 1.50 | 30 sec | 0.11 | 120 | 1.58 | |
| | | | | | | 45 sec | 0.11 | 126 | 1.60 | 0.63 g/m² |
| | | | | | | 60 sec | 0.11 | 129 | 1.63 | |
| | R | 3 min 30 sec | 0.10 | 100 | 1.50 | 30 sec | 0.12 | 123 | 1.69 | |
| | | | | | | 45 sec | 0.12 | 126 | 1.72 | |
| | | | | | | 60 sec | 0.12 | 132 | 1.80 | |
| 27 | B | 3 min 30 sec | 0.07 | 100 | 1.50 | 30 sec | 0.07 | 102 | 1.54 | |
| | | | | | | 45 sec | 0.07 | 112 | 1.62 | |
| | | | | | | 60 sec | 0.07 | 120 | 1.65 | |
| | G | 3 min 30 sec | 0.10 | 100 | 1.50 | 30 sec | 0.09 | 102 | 1.47 | |
| | | | | | | 45 sec | 0.09 | 110 | 1.59 | 0.75 g/m² |
| | | | | | | 60 sec | 0.09 | 115 | 1.70 | |
| | R | 3 min 30 sec | 0.11 | | 1.50 | 30 sec | 0.11 | 115 | 1.62 | |
| | | | | | | 45 sec | 0.11 | 120 | 1.67 | |
| | | | | | | 60 sec | 0.11 | 126 | 1.79 | |
| 28 | B | 3 min 30 sec | 0.08 | 100 | 1.50 | 30 sec | 0.08 | 76 | 1.22 | |
| | | | | | | 45 sec | 0.08 | 98 | 1.38 | |
| | | | | | | 60 sec | 0.09 | 110 | 1.60 | |
| | G | 3 min 30 sec | 0.10 | 100 | 1.50 | 30 sec | 0.09 | 79 | 1.49 | |
| | | | | | | 45 sec | 0.10 | 95 | 1.59 | 0.85 g/m² |
| | | | | | | 60 sec | 0.10 | 107 | 1.63 | |
| | R | 3 min 30 sec | 0.11 | 100 | 1.50 | 30 sec | 0.11 | 83 | 1.55 | |
| | | | | | | 45 sec | 0.11 | 98 | 1.64 | |
| | | | | | | 60 sec | 0.11 | 107 | 1.72 | |

The values surrounded by squares in Table 12 denote the results according to the present invention.

As is apparent from the results shown in Table 12, color prints having an excellent color forming property and a low level of fog can be obtained according to the present invention even when a rapid processing is carried out using a color developing solution which does not contain benzyl alcohol. Further, when the results with respect to Samples 24, 27, and 28 are compared, it can be seen that the effect of the present invention is particularly effective in the case wherein the coating amount of silver is maintained at not more than 0.78 g/m² of the color photographic light-sensitive material.

While the invention has been described in detail and with reference to specific embodiments thereof, it will be apparent to one skilled in the art that various changes and modifications can be made therein without departing from the spirit and scope thereof.

What is claimed is:

1. A method of forming a color image which comprises processing a silver halide color photographic material comprising a reflective support having thereon at least one light-sensitive layer containing at least one coupler which forms a dye upon a coupling reaction with an oxidation product of an aromatic primary amine color developing agent and a silver halide emulsion which contains at least 80% by mol of silver chloride with a color developing solution which contains not more than 0.002 mol of a bromine ion per liter for a development time of not more than 2 minutes and 30 seconds in the presence of at least one compound represented by the following formula (I), (II), or (III):

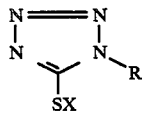

(I)

wherein R represents an alkyl group, an alkenyl group, or an aryl group; and X represents a hydrogen atom, an alkali metal atom, an ammonium group, or a precursor;

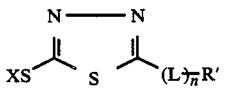

(II)

wherein L represents a divalent connecting group; R′ represents a hydrogen atom, an alkyl group, an alkenyl group, or an aryl group; X has the same meaning as defined in formula (I); and n represents 0 or 1; and

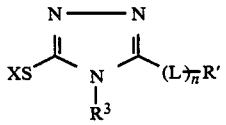

(III)

wherein $R^1$, X, L, and n each has the same meaning as defined in formula (II); $R^3$ has the same meaning as defined for R′; and $R^1$ and $R^3$ may be the same or different, wherein the color developing solution has a benzyl alcohol concentration of not more than 0.5 ml per liter of the color developing solution and wherein the content of silver iodide in the silver halide emulsion which contains at least 80% by mol of silver chloride is not more than 1% by mol.

2. A method of forming a color image as claimed in claim 1, wherein a substituent for the substituted alkyl group or the substituted alkenyl group represented by R, R′, or $R^3$ is one or more members selected from the group consisting of a halogen atom, a nitro group, a cyano group, a hydroxyl group, an alkoxy group, an aryl group, an acylamino group, an alkoxycarbonylamino group, a ureido group, an amino group, a heterocyclic group, an acyl group, a sulfamoyl group, a sulfonamido group, a thioureido group, a carbamoyl group, an alkylthio group, an arylthio group, a heterocyclic thio group, and a carboxylic acid group or a sulfonic acid group or a salt thereof.

3. A method of forming a color image as claimed in claim 1, wherein a substituent for the substituted aryl group represented by R, R′, or $R^3$ is one or more members selected from the group consisting of an alkyl group, a halogen atom, a nitro group, a cyano group, a hydroxyl group, an alkoxy group, an aryl group, an acylamino group, an alkoxycarbonylamino group, a ureido group, an amino group, a heterocyclic group, an acyl group, a sulfamoyl group, a sulfonamido group, a thioureido group, a carbamoyl group, an alkylthio group, an arylthio group, a heterocyclic thio group, and a carboxylic acid group or a sulfonic acid group or a salt thereof.

4. A method of forming a color image as claimed in claim 1, wherein the divalent connecting group represented by L is

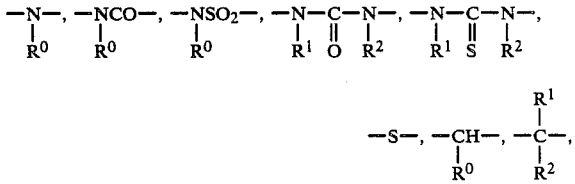

or a combination thereof, wherein $R^0$, $R^1$, and $R^2$ each represents a hydrogen atom, an alkyl group, or an aralkyl group.

5. A method of forming a color image as claimed in claim 1, wherein the compound represented by formulae (I), (II), or (III) is present in a light-sensitive hydrophilic colloid layer or a light-insensitive hydrophilic colloid layer of the silver halide color photographic material and/or the color developing solution.

6. A method of forming a color image as claimed in claim 5, wherein an amount of the compound to be incorporated into the silver halide color photographic material is from $1\times10^{-5}$ mol to $5\times10^{-2}$ mol per mol of the silver halide present therein.

7. A method of forming a color image as claimed in claim 5, wherein an amount of the compound to be added to the color developing solution is from $1\times10^{-6}$ mol to $1\times10^{-3}$ mol per liter of the solution.

8. A method of forming a color image as claimed in claim 1, wherein the silver halide emulsion is a silver chlorobromide emulsion, and the compound is selected from those represented by formula (I) or (II).

9. A method of forming a color image as claimed in claim 1, wherein an amount of silver halide coated on the reflective support, which is calculated in terms of silver, is not more than 0.78 g/m$^2$.

10. A method of forming a color image as claimed in claim 1, wherein the silver halide emulsion is a monodispersed silver halide emulsion having a ratio of a standard deviation to an average grain size of not more than 0.2.

11. A method of forming a color image as claimed in claim 1, wherein the silver halide color photographic material comprises at least one blue-sensitive silver halide emulsion layer containing at least one yellow color forming coupler, at least one green-sensitive silver halide emulsion layer containing at least one magenta color forming coupler, and at least one red-sensitive silver halide emulsion layer containing at least one cyan color forming coupler.

12. A silver halide color photographic material which comprises a reflective support having thereon at least one light-sensitive layer containing at least one coupler which forms a dye upon a coupling reaction with an oxidation product of an aromatic primary amine color developing agent and a silver halide emulsion which contains at least 80% by mol of silver chloride and substantially no silver iodide, wherein the silver halide color photographic material has at least one layer coated on the support, which contains at least one compound represented by the following formulae (I), (II), or (III):

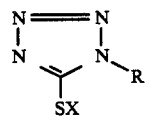

(I)

wherein R represents an alkyl group, an alkenyl group, or an aryl group; and X represents a hydrogen atom, an alkali metal atom, an ammonium group, or a precursor;

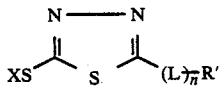

(II)

wherein L represents a divalent connecting group; R′ represents a hydrogen atom, an alkyl group, an alkenyl group, or an aryl group; X has the same meaning as defined in formula (I); and n represents 0 or 1; and

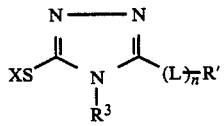

(III)

wherein R′, X, L, and n each has the same meaning as defined in formula (II); $R^3$ has the same meaning as defined for R′; and R′ and $R^3$ may be the same or different; and an amount of silver halide coated on the support, which is calculated in terms of silver, is not more than 0.78 g/m$^2$.

13. A silver halide color photographic material as claimed in claim 12, wherein a substituent for the substituted alkyl group or the substituted alkenyl group represented by R, R′, or $R^3$ is one or more members selected from the group consisting of a halogen atom, a nitro group, a cyano group, a hydroxyl group, an alkoxy group, an aryl group, an acylamino group, an alkoxycarbonylamino group, a ureido group, an amino group, a heterocyclic group, an acyl group, a sulfamoyl group, a sulfonamido group, a thioureido group, a carbamoyl group, an alkylthio group, an arylthio group, a heterocyclic thio group, and a carboxylic acid group or a sulfonic acid group or a salt thereof.

14. A silver halide color photographic material as claimed in claim 12, wherein a substituent for the substituted aryl group represented by R, R′, or $R^3$ is one or more members selected from the group consisting of an alkyl group, a halogen atom, a nitro group, a cyano group, a hydroxyl group, an alkoxy group, an aryl group, an acylamino group, an alkoxycarbonylamino group, a ureido group, an amino group, a heterocyclic group, an acyl group, a sulfamoyl group, a sulfonamido group, a thioureido group, a carbamoyl group, an alkylthio group, an arylthio group, a heterocyclic thio group, and a carboxylic acid group or a sulfonic acid group or a salt thereof.

15. A silver halide color photographic material as claimed in claim 12, wherein the divalent connecting group represented by L is

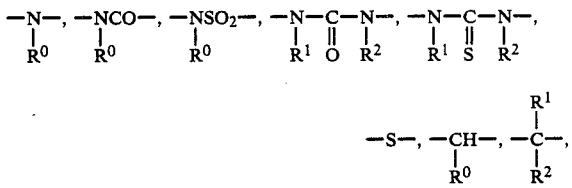

or a combination thereof, wherein $R^0$, $R^1$, and $R^2$ each represents a hydrogen atom, an alkyl group, or an aralkyl group.

16. A silver halide color photographic material as claimed in claim 12, wherein an amount of the compound to be incorporated into the silver halide color photographic material is from $1\times10^{-5}$ mol to $5\times10^{-2}$ mol per mol of the silver halide present therein.

17. A silver halide color photographic material as claimed in claim 12, wherein a content of silver iodide is not more than 1% by mol.

18. A silver halide color photograpic material as claimed in claim 12, wherein the compound is selected from those represented by formula (I) or (II).

19. A silver halide color photographic material as claimed in claim 12, wherein the silver halide emulsion contains at least 90% by mol of silver chloride.

20. A silver halide color photographic material as claimed in claim 12, wherein the silver halide emulsion is a monodispersed silver halide emulsion having a ratio of a standard deviation to an average grain size of not more than 0.2.

21. A silver halide color photographic material as claimed in claim 12, wherein the silver halide color photographic material comprises at least one blue-sensitive silver halide emulsion layer containing at least one yellow color forming coupler, at least one green-sensitive silver halide emulsion layer containing at least one magenta color forming coupler, and at least one red-sensitive silver halide emulsion layer containing at least one cyan color forming coupler.

22. A method of forming a color image as claimed in claim 1, wherein said precursor is a group capable of becoming a hydrogen atom or an alkali metal atom under alkaline conditions.

23. A method of forming a color image as claimed in claim 22, wherein said precursor is selected from the group consisting of an acetyl group, a cyanoethyl group and a methane sulfonyl ethyl group.

24. A silver halide color photographic material as claimed in claim 12, wherein said precursor is a group capable of becoming a hydrogen atom or an alkali metal atom under alkaline conditions.

25. A silver halide color photographic material as claimed in claim 24, wherein said precursor is selected from the group consisting of an acetyl group, a cyanoethyl group and a methane sulfonyl ethyl group.

* * * * *